US007448735B2

(12) United States Patent
Hibbard et al.

(10) Patent No.: US 7,448,735 B2
(45) Date of Patent: Nov. 11, 2008

(54) INK PRIMING ARRANGEMENT FOR INKJET PRINTHEAD

(75) Inventors: Christopher Hibbard, Balmain (AU); Kia Silverbrook, Balmain (AU); Akira Nakazawa, Balmain (AU); Garry Raymond Jackson, Balmain (AU); John Douglas Peter Morgan, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 393 days.

(21) Appl. No.: 11/293,835

(22) Filed: Dec. 5, 2005

(65) Prior Publication Data

US 2007/0126824 A1 Jun. 7, 2007

(51) Int. Cl.
*B41J 2/175* (2006.01)
*B41J 2/15* (2006.01)

(52) U.S. Cl. ..... 347/85; 347/40

(58) Field of Classification Search ..... 347/9, 347/20, 40, 44, 47, 85, 86, 87
See application file for complete search history.

(56) References Cited

U.S. PATENT DOCUMENTS 4,183,031 A * 1/1980 Kyser et al. ..... 347/86
5,673,073 A * 9/1997 Childers et al. ..... 347/86
5,731,824 A * 3/1998 Kneezel et al. ..... 347/7
5,903,292 A * 5/1999 Scheffelin et al. ..... 347/86
6,003,984 A * 12/1999 Bohorquez et al. ..... 347/86
6,109,740 A * 8/2000 Namekawa et al. ..... 347/85
6,234,626 B1 * 5/2001 Axtell et al. ..... 347/108
6,298,783 B1 10/2001 O'Mera et al.
6,443,567 B1 * 9/2002 Hayashi et al. ..... 347/85
6,575,561 B1 6/2003 Silverbrook
6,727,996 B1 * 4/2004 Silverbrook et al. ..... 358/1.1
6,802,594 B2 10/2004 Silverbrook
6,969,161 B2 * 11/2005 Kuwabara et al. ..... 347/85

FOREIGN PATENT DOCUMENTS

JP 2005-5271368 A 10/2005

* cited by examiner

*Primary Examiner*—Anh T. N. Vo

(57) ABSTRACT

An ink priming arrangement for an inkjet printhead, the inkjet printhead having a plurality of ink ejection nozzles, the priming arrangement comprising: an ink bag containing ink for distribution to the nozzles via a fluid path between the ink bag and the nozzles; a force applicator arranged to apply inwardly directed force on at least one exterior wall of the ink bag so as to reduce an available fluid volume of the ink bag, thereby causing ink to flow from the ink bag to the nozzles along the fluid path; and a biasing member arranged in the ink bag to apply outwardly directed force on at least one interior wall of the ink bag so as to restrain the reduction of available fluid volume of the ink bag, wherein the biasing member is configured so as to apply the outwardly directed force only once the available fluid volume of the ink bag has been reduced to a predetermined volume.

18 Claims, 23 Drawing Sheets

INK PRIMING ARRANGEMENT FOR INKJET PRINTHEAD

FIELD OF THE INVENTION

The present invention relates to an ink priming arrangement for an inkjet printhead in which the priming is controlled by the configuration of an ink supply of the printhead.

CO-PENDING APPLICATIONS

The following applications have been filed by the Applicant simultaneously with the present application:

| | | | | | |
|---|---|---|---|---|---|
| 11/293800 | 11/293802 | 11/293801 | 11/293808 | 11/293809 | 11/293832 |
| 11/293838 | 11/293825 | 11/293841 | 11/293799 | 11/293796 | 11/293797 |
| 11/293798 | 11/293804 | 11/293840 | 11/293803 | 11/293833 | 11/293834 |
| 11/293836 | 11/293837 | 11/293792 | 11/293794 | 11/293839 | 11/293826 |
| 11/293829 | 11/293830 | 11/293827 | 11/293828 | 7270494 | 11/293823 |
| 11/293824 | 11/293831 | 11/293815 | 11/293819 | 11/293818 | 11/293817 |
| 11/293816 | 11/293820 | 11/293813 | 11/293822 | 11/293812 | 7357496 |
| 11/293814 | 11/293793 | 11/293842 | 11/293811 | 11/293807 | 11/293806 |
| 11/293805 | 11/293810 | | | | |

The disclosures of these co-pending applications are incorporated herein by reference.

CROSS REFERENCES TO RELATED APPLICATIONS

Various methods, systems and apparatus relating to the present invention are disclosed in the following U.S. Patents/Patent Applications filed by the applicant or assignee of the present invention:

| | | | | | |
|---|---|---|---|---|---|
| 6750901 | 6476863 | 6788336 | 7249108 | 6566858 | 6331946 |
| 6246970 | 6442525 | 7346586 | 09/505951 | 6374354 | 7246098 |
| 6816968 | 6757832 | 6334190 | 6745331 | 7249109 | 7197642 |
| 7093139 | 10/636263 | 10/636283 | 10/866608 | 7210038 | 10/902883 |
| 10/940653 | 10/942858 | 7364256 | 7258417 | 7293853 | 7328968 |
| 7270395 | 11/003404 | 11/003419 | 7334864 | 7255419 | 7284819 |
| 7229148 | 7258416 | 7273263 | 7270393 | 6984017 | 7347526 |
| 7357477 | 11/003463 | 7364255 | 7357476 | 11/003614 | 7284820 |
| 7341328 | 7246875 | 7322669 | 11/246676 | 11/246677 | 11/246678 |
| 11/246679 | 11/246680 | 11/246681 | 11/246714 | 11/246713 | 11/246689 |
| 11/246671 | 11/246704 | 11/246710 | 11/246688 | 11/246716 | 11/246715 |
| 7367648 | 7370936 | 11/246705 | 11/246708 | 11/246693 | 11/246692 |
| 11/246696 | 11/246695 | 11/246694 | 10/922842 | 10/922848 | 6623101 |
| 6406129 | 6505916 | 6457809 | 6550895 | 6457812 | 7152962 |
| 6428133 | 7204941 | 7282164 | 10/815628 | 7278727 | 10/913373 |
| 10/913374 | 7367665 | 7138391 | 7153956 | 10/913380 | 10/913379 |
| 10/913376 | 7122076 | 7148345 | 11/172816 | 11/172815 | 11/172814 |
| 10/407212 | 7252366 | 10/683064 | 7360865 | 6746105 | 11/246687 |
| 11/246718 | 7322681 | 11/246686 | 11/246703 | 11/246691 | 11/246711 |
| 11/246690 | 11/246712 | 11/246717 | 11/246709 | 11/246700 | 11/246701 |
| 11/246702 | 11/246668 | 11/246697 | 11/246698 | 11/246699 | 11/246675 |
| 11/246674 | 11/246667 | 7156508 | 7159972 | 7083271 | 7165834 |
| 7080894 | 7201469 | 7090336 | 7156489 | 10/760233 | 10/760246 |
| 7083257 | 7258422 | 7255423 | 7219980 | 10/760253 | 10/760255 |
| 7367649 | 7118192 | 10/760194 | 7322672 | 7077505 | 7198354 |
| 7077504 | 10/760189 | 7198355 | 10/760232 | 7322676 | 7152959 |
| 7213906 | 7178901 | 7222938 | 7108353 | 7104629 | 7303930 |
| 11/246672 | 11/246673 | 11/246683 | 11/246682 | 7246886 | 7128400 |
| 7108355 | 6991322 | 7287836 | 7118197 | 10/728784 | 7364269 |
| 7077493 | 6962402 | 10/728803 | 7147308 | 10/728779 | 7118198 |
| 7168790 | 7172270 | 7229155 | 6830318 | 7195342 | 7175261 |
| 10/773183 | 7108356 | 7118202 | 10/773186 | 7134744 | 10/773185 |
| 7134743 | 7182439 | 7210768 | 10/773187 | 7134745 | 7156484 |
| 7118201 | 7111926 | 10/773184 | 7018021 | 11/060751 | 11/060805 |
| 11/188017 | 11/097308 | 11/097309 | 7246876 | 11/097299 | 11/097310 |
| 7377623 | 7328978 | 7334876 | 7147306 | 09/575197 | 7079712 |

-continued

| | | | | | |
|---|---|---|---|---|---|
| 6825945 | 7330974 | 6813039 | 6987506 | 7038797 | 6980318 |
| 6816274 | 7102772 | 7350236 | 6681045 | 6728000 | 7173722 |
| 7088459 | 09/575181 | 7068382 | 7062651 | 6789194 | 6789191 |
| 6644642 | 6502614 | 6622999 | 6669385 | 6549935 | 6987573 |
| 6727996 | 6591884 | 6439706 | 6760119 | 7295332 | 6290349 |
| 6428155 | 6785016 | 6870966 | 6822639 | 6737591 | 7055739 |
| 7233320 | 6830196 | 6832717 | 6957768 | 09/575172 | 7170499 |
| 7106888 | 7123239 | 10/727181 | 10/727162 | 7377608 | 10/727245 |
| 7121639 | 7165824 | 7152942 | 10/727157 | 7181572 | 7096137 |
| 7302592 | 7278034 | 7188282 | 10/727159 | 10/727180 | 10/727179 |
| 10/727192 | 10/727274 | 10/727164 | 10/727161 | 10/727198 | 10/727158 |
| 10/754536 | 10/754938 | 10/727160 | 10/934720 | 7171323 | 7278697 |
| 7369270 | 6795215 | 7070098 | 7154638 | 6805419 | 6859289 |
| 6977751 | 6398332 | 6394573 | 6622923 | 6747760 | 6921144 |
| 10/884881 | 7092112 | 7192106 | 11/039866 | 7173739 | 6986560 |
| 7008033 | 11/148237 | 7222780 | 7270391 | 7195328 | 7182422 |
| 7374266 | 10/854522 | 10/854488 | 7281330 | 10/854503 | 7328956 |
| 10/854509 | 7188928 | 7093989 | 7377609 | 10/854495 | 10/854498 |
| 10/854511 | 10/854512 | 10/854525 | 10/854526 | 10/854516 | 7252353 |
| 10/854515 | 7267417 | 10/854505 | 10/854493 | 7275805 | 7314261 |
| 10/854490 | 7281777 | 7290852 | 10/854528 | 10/854523 | 10/854527 |
| 10/854524 | 10/854520 | 10/854514 | 10/854519 | 10/854513 | 10/854499 |
| 10/854501 | 7266661 | 7243193 | 10/854518 | 10/854517 | 10/934628 |
| 7163345 | 10/760254 | 10/760210 | 7364263 | 7201468 | 7360868 |
| 10/760249 | 7234802 | 7303255 | 7287846 | 7156511 | 10/760264 |
| 7258432 | 7097291 | 10/760222 | 10/760248 | 7083273 | 7367647 |
| 7374355 | 10/760204 | 10/760205 | 10/760206 | 10/760267 | 10/760270 |
| 7198352 | 7364264 | 7303251 | 7201470 | 7121655 | 7293861 |
| 7232208 | 7328985 | 7344232 | 7083272 | 11/014764 | 11/014763 |
| 7331663 | 7360861 | 7328973 | 11/014760 | 11/014757 | 7303252 |
| 7249822 | 11/014762 | 7311382 | 7360860 | 7364257 | 11/014736 |
| 7350896 | 11/014758 | 11/014725 | 7331660 | 11/014738 | 11/014737 |
| 7322684 | 7322685 | 7311381 | 7270405 | 7303268 | 11/014735 |
| 11/014734 | 11/014719 | 11/014750 | 11/014749 | 7249833 | 11/014769 |
| 11/014729 | 7331661 | 11/014733 | 7300140 | 7357492 | 7357493 |
| 11/014766 | 11/014740 | 7284816 | 7284845 | 7255430 | 11/014744 |
| 7328984 | 7350913 | 7322671 | 11/014718 | 11/014717 | 11/014716 |
| 11/014732 | 7347534 | 11/097268 | 11/097185 | 7367650 | |

The disclosures of these applications and patents are incorporated herein by reference.

BACKGROUND OF THE INVENTION

Known ink priming arrangements for inkjet printheads using vacuum creation to set-up the required positive pressure at the nozzles of the printhead are complex and slow down production of the printheads.

A simplified priming arrangement is disclosed in U.S. Pat. No. 6,183,073. In this simplified arrangement, manual force is applied to the exterior of an ink bag to create positive pressure at the nozzles. The application of this force is continuously monitored, either manually or automatically, by determining whether ink is present in an ink level window. Once ink is present the application of the force is ceased. Whilst this provides a simplified arrangement, complexity still exists in the determination of when to stop applying the positive pressure force. This may also lead to an unacceptable amount of ink being wasted during priming, by too much being passed to nozzles before the determination is made.

SUMMARY OF THE INVENTION

The present invention positions a spring within the ink bag to resist the exterior positive pressure force, thereby simplifying the priming arrangement. Further, since the presence of a predetermined available ink volume within the ink bag is being used to determine when priming is ceased, the possibility of wasting ink during priming is reduced.

In a first aspect the present invention provides an ink priming arrangement for an inkjet printhead, the inkjet printhead having a plurality of ink ejection nozzles, the priming arrangement comprising:

an ink bag containing ink for distribution to the nozzles via a fluid path between the ink bag and the nozzles;

a force applicator arranged to apply inwardly directed force on at least one exterior wall of the ink bag so as to reduce an available fluid volume of the ink bag, thereby causing ink to flow from the ink bag to the nozzles along the fluid path; and a biasing member arranged in the ink bag to apply outwardly directed force on at least one interior wall of the ink bag so as to restrain the reduction of available fluid volume of the ink bag, wherein the biasing member is configured so as to apply the outwardly directed force only once the available fluid volume of the ink bag has been reduced to a predetermined volume.

Optionally, the biasing member incorporates a leaf spring.

Optionally, the leaf spring is made from a material having shape-memory characteristic.

Optionally, the material is Mylar.

Optionally, the leaf spring is formed by folding an elongate arcuate piece of the material about an approximate centre line orthogonal to the longitudinal extent thereof so that the leaf spring exhibits an outwardly directed spring restoring force.

Optionally, the leaf spring is formed so as to have a folded longitudinal length and radius of curvature which result in the leaf spring being able to float within the ink contained in the ink bag prior to the application of the inwardly directed force by the force applicator.

Optionally, the ink bag is configured to have an available fluid volume of at least 19 milliliters.

Optionally, the ink bag is configured to have an available fluid volume of at least 23 milliliters.

Optionally, the predetermined available fluid volume is at least 15 milliliters.

Optionally, the fluid path connects the ink bag to at least 6400 nozzles of the printhead.

Optionally, each nozzle of the printhead is configured to eject an ink drop having a volume of about 1.2 picoliters.

Optionally, the nozzles of the printhead are arranged so as to print at a resolution of 1600 dots per inch.

In a further aspect there is provided an ink priming arrangement, comprising three of said ink bags.

Optionally, a first ink bag contains magenta ink, a second ink bag contains cyan ink and a third ink bag contains yellow ink.

Optionally, the fluid path of the first ink bag connects the first ink bag to 12800 nozzles of the printhead, the fluid path of the second ink bag connects the second ink bag to 12800 nozzles of the printhead, and the fluid path of the third ink bag connects the third ink bag to 6400 nozzles of the printhead.

Optionally, the printhead has 32000 nozzles.

Optionally, the printhead is a pagewidth printhead, having a pagewidth of 100.9 millimeters.

Optionally, the printhead comprises five linked printhead integrated circuits arranged to span the pagewidth, each printhead integrated circuit having 6400 nozzles arranged in rows.

Optionally, the fluid path of each ink bag connects the respective ink bag to at least two nozzle rows of each printhead integrated circuit.

Optionally, the fluid path of first ink bag connects the first ink bag to four nozzle rows of each printhead integrated circuit, the fluid path of second ink bag connects the second bag to four nozzle rows of each printhead integrated circuit, and the fluid path of third ink bag connects the third ink bag to two nozzle rows of each printhead integrated circuit.

In a second aspect the present invention provides a printhead assembly comprising:

at least one printhead integrated circuit having a plurality of ink ejection nozzles; and an ink distribution support mounting the, or each, printhead integrated circuit, the ink distribution support being arranged, in use, to distribute ink to the nozzles, the printhead assembly being arranged to be mounted to a printer at the ink distribution support, wherein the ink distribution support is provided with at least one reference feature, the, or each, reference feature serving to provide information on the location of the nozzles upon mounting of the printhead assembly to the printer.

Optionally, the ink distribution support is an elongate support, and the, or each, printhead integrated circuit is mounted to extend longitudinally along the elongate support.

Optionally, the, or each, printhead integrated circuit is mounted along the elongate support so that the nozzles create a printing zone which extends across a pagewidth.

Optionally, the pagewidth is 100.9 millimeters.

Optionally, the, or each, reference feature is arranged beyond the longitudinal extent of the printing zone.

Optionally, the elongate support is formed as a molding, and the, or each, reference feature is molded as part of the support molding.

Optionally, at least one reference feature is provided at either longitudinal end of the elongate support.

Optionally, the, or each, reference feature is configured to cooperate with a corresponding complementary feature of the printer upon mounting of the printhead assembly to the printer, the cooperation providing the information on the location of the nozzles.

Optionally, the at least one reference feature is a slot in the ink distribution support.

Optionally, the complementary feature of the printer is a mesa feature configured to cooperate with the slot in the ink distribution support.

Optionally, the at least one reference feature is a flat surface of a plurality of corners of the ink distribution support.

Optionally, a plurality of the reference features are provided, one of the reference features being a slot in the ink distribution support and the other reference features being a flat surface of a plurality of corners of the ink distribution support.

Optionally, the printhead integrated circuit is formed from a silicon wafer.

Optionally, the ink distribution support is a molding formed from liquid crystal polymer.

Optionally, the liquid crystal polymer of the ink distribution support has thermal expansion characteristics similar to those of the silicon of the printhead integrated circuit.

Optionally, the, or each, printhead integrated circuit has at least 6400 nozzles.

In a further aspect there is provided a printhead assembly, comprising 32000 nozzles spanned over the, or each, printhead integrated circuit.

In a further aspect there is provided a printhead assembly further comprising five printhead integrated circuits which are arranged to span a pagewidth.

Optionally, the pagewidth is 100.9 millimeters.

Optionally, the nozzles of the printhead integrated circuit are arranged to print at a resolution of 1600 dots per inch.

In a third aspect the present invention provides a printing cartridge for an inkjet printer, the cartridge comprising:

an ink supply; and a printhead assembly comprising at least one printhead integrated circuit having a plurality of ink ejection nozzles and an ink distribution support mounting the, or each, printhead integrated circuit, the ink distribution support being arranged, in use, to distribute ink from the ink supply to the nozzles, wherein the printing cartridge is mounted to the printer at the ink distribution support, and wherein the ink distribution support is provided with at least one reference feature, the, or each, reference feature serving to provide information on the location of the nozzles upon mounting of the printing cartridge to the printer.

Optionally, the ink distribution support is an elongate support, and the, or each, printhead integrated circuit is mounted to extend longitudinally along the elongate support.

Optionally, the, or each, printhead integrated circuit is mounted along the elongate support so that the nozzles create a printing zone which extends across a pagewidth.

Optionally, the pagewidth is 100.9 millimeters.

Optionally, the, or each, reference feature is arranged beyond the longitudinal extent of the printing zone.

Optionally, the elongate support is formed as a molding, and the, or each, reference feature is molded as part of the support molding.

Optionally, at least one reference feature is provided at either longitudinal end of the elongate support.

Optionally, the, or each, reference feature is configured to cooperate with a corresponding complementary feature of the printer upon mounting of the printing cartridge to the printer, the cooperation providing the information on the location of the nozzles.

Optionally, the at least one reference feature is a slot in the ink distribution support.

Optionally, the complementary feature of the printer is a mesa feature configured to cooperate with the slot in the ink distribution support.

Optionally, the at least one reference feature is a flat surface of a plurality of corners of the ink distribution support.

Optionally, a plurality of the reference features are provided, one of the reference features being a slot in the ink distribution support and the other reference features being a flat surface of a plurality of corners of the ink distribution support.

Optionally, the printhead integrated circuit is formed from a silicon wafer.

Optionally, the ink distribution support is a molding formed from liquid crystal polymer.

Optionally, the liquid crystal polymer of the ink distribution support has thermal expansion characteristics similar to those of the silicon of the printhead integrated circuit.

Optionally, the, or each, printhead integrated circuit has at least 6400 nozzles.

Optionally, the printhead assembly comprises 32000 nozzles spanned over the, or each, printhead integrated circuit.

In a further aspect there is provided a printing cartridge wherein the printhead assembly comprises five printhead integrated circuits which are arranged to span a pagewidth.

Optionally, wherein the pagewidth is 100.9 millimeters.

Optionally, the nozzles of the printhead integrated circuit are arranged to print at a resolution of 1600 dots per inch.

In a fourth aspect the present invention provides an inkjet printer comprising:

a body configured to receive a printhead assembly, the printhead assembly comprising at least one printhead integrated circuit having a plurality of ink ejection nozzles and an ink distribution support mounting the, or each, printhead integrated circuit, the ink distribution support being arranged, in use, to distribute ink to the nozzles; and at least one mounting feature on the body for mounting the printhead assembly at the ink distribution support, the, or each, mounting feature being configured to cooperate with a corresponding complementary reference feature of the ink distribution support upon mounting of the printhead assembly to the printer, the cooperation providing information on the location of the nozzles.

Optionally, the ink distribution support is an elongate support, and the, or each, printhead integrated circuit is mounted to extend longitudinally along the elongate support.

Optionally, the, or each, printhead integrated circuit is mounted along the elongate support so that the nozzles create a printing zone which extends across a pagewidth.

Optionally, the pagewidth is 100.9 millimeters.

Optionally, the, or each, reference feature of the ink distribution support is arranged beyond the longitudinal extent of the printing zone and the, or each, mounting feature is arranged to correspond with the corresponding reference feature.

Optionally, the printhead assembly is incorporated in a printing cartridge, and the body of the printer has a cartridge receiving slot for removably receiving the printing cartridge.

Optionally, the at least one mounting feature is arranged in the cartridge receiving slot.

Optionally, the at least one mounting feature is a mesa feature arranged in the cartridge receiving slot.

Optionally, the complementary reference feature of the ink distribution support is a slot configured to cooperate with the mesa feature.

Optionally, the at least one mounting feature is at least one protrusion arranged in the cartridge receiving slot.

Optionally, the complementary reference feature of the ink distribution support is a flat surface of a plurality of corners of the ink distribution support which is configured to cooperate with the protrusions.

Optionally, a plurality of the mounting features are provided, one of the mounting features being a mesa feature arranged in the cartridge receiving slot and the other mounting features being protrusions arranged in the cartridge receiving slot.

In a further aspect there is provided a printer, a plurality of the complementary reference features of the ink distribution support are provided, one of the reference features being a slot in the ink distribution support configured to cooperate with the mesa feature, and the other reference features being a flat surface of a plurality of corners of the ink distribution support which are configured to cooperate with the protrusions.

In a further aspect there is provided a printer, further comprising print control circuitry for controlling operation of the ink ejection nozzles.

Optionally, the print control circuitry is configured to use the information of the location of the nozzles to control said operation.

In a further aspect there is provided a printer, further comprising print control circuitry for controlling operation of the ink ejection nozzles of the received printing cartridge.

Optionally, the print control circuitry is configured to use the information of the location of the nozzles to control said operation.

Optionally, the print control circuitry incorporates an electrical connection interface arranged in the cartridge receiving slot for communicating power and data to the nozzles of the received printing cartridge via electrical contacts of the printhead assembly.

Optionally, the electrical connection interface defines at least one further mounting feature configured to cooperate with a further complementary reference feature of the printing cartridge.

Optionally, the further complementary reference feature of the printing cartridge is a surface adjacent the electrical contacts of the printhead assembly which is configured to cooperate with the electrical connection interface.

In a fifth aspect the present invention provides a method of locating a printhead assembly on a printer, the method comprising the steps of:

providing a printhead assembly comprising at least one printhead integrated circuit having a plurality of ink ejection nozzles and an ink distribution support mounting the, or each, printhead integrated circuit, the ink distribution support being arranged, in use, to distribute ink from the ink supply to the nozzles;

mounting the printhead assembly to the printer by bringing at least one reference feature provided on the ink distribution support into cooperation with a corresponding complementary feature of the printer; and determining from the cooperation the location of the nozzles.

Optionally, the ink distribution support is an elongate support, and the, or each, printhead integrated circuit is mounted to extend longitudinally along the elongate support.

Optionally, the, or each, printhead integrated circuit is mounted along the elongate support so that the nozzles create a printing zone which extends across a pagewidth.

Optionally, the, or each, reference feature is arranged beyond the longitudinal extent of the printing zone.

Optionally, the elongate support is formed as a molding, and the, or each, reference feature is molded as part of the support molding.

Optionally, the moulding is formed from liquid crystal polymer.

Optionally, the printhead integrated circuit is formed from a silicon wafer.

Optionally, the liquid crystal polymer of the ink distribution support has thermal expansion characteristics similar to those of the silicon of the printhead integrated circuit.

Optionally, at least one reference feature is provided at either longitudinal end of the elongate support.

Optionally, the at least one reference feature is a slot in the ink distribution support.

Optionally, the mounting step comprises cooperating the slot in the ink distribution support with a mesa feature of the printer.

Optionally, the at least one reference feature is a flat surface of a plurality of corners of the ink distribution support.

Optionally, the mounting step comprises cooperating the flat surfaces of the ink distribution support with protrusions of the printer.

In a sixth aspect the present invention provides a printing cartridge comprising:

a body configured to removably engage with an inkjet printer;

a printhead assembly mounted to the body, the printhead assembly comprising at least one printhead integrated circuit having a plurality of ink ejection nozzles and a support member mounting the, or each, printhead integrated circuit, the nozzles being operated, in use, to print on media by ejecting ink thereon; and a capping mechanism for capping the nozzles during non-operation; and a mounting arrangement for commonly mounting the printhead assembly and capping mechanism to the body, the support member of the printhead assembly being directly mounted to the body and the capping mechanism being directly mounted to the support member.

Optionally, the support member is an ink distribution support which is arranged, in use, to distribute ink to the nozzles.

Optionally, the ink distribution support is an elongate support, and the, or each, printhead integrated circuit is mounted to extend longitudinally along the elongate support.

Optionally, the, or each, printhead integrated circuit is mounted along the elongate support so that the nozzles create a printing zone which extends across a pagewidth.

Optionally, the pagewidth is 100.9 millimeters.

Optionally, the capping mechanism comprises an elongate capper having a capping zone which is commensurate with the printing zone.

Optionally, the mounting arrangement incorporates a fixing arrangement arranged beyond the longitudinal extent of the printing and capping zones at one end of the elongate support and capper and a confining arrangement arranged beyond the longitudinal extent of the printing and capping zones at the other end of the elongate support and capper.

Optionally, the fixing arrangement incorporates aligned holes through each of the cartridge body, printhead assembly and capping mechanism, a first pin configured to pass through each of the holes and a locking member for locking the first pin within the holes.

Optionally, the confining arrangement incorporates aligned slots through each of the cartridge body, printhead assembly and capping mechanism, a second pin configured to pass through each of the slots and a biasing member for locking the second pin within the slots and biasing the cartridge body, printhead assembly and capping mechanism together at the second pin whilst allowing relative movement of the cartridge body, printhead assembly and capping mechanism.

Optionally, the ink distribution support is provided with at least one reference feature, the, or each, reference feature serving to provide information on the location of the nozzles upon mounting of the printing cartridge to the printer.

Optionally, the, or each, reference feature is arranged beyond the longitudinal extent of the printing zone.

Optionally, the, or each, reference feature is configured to cooperate with a corresponding complementary feature of the printer upon mounting of the printing cartridge to the printer, the cooperation providing the information on the location of the nozzles.

Optionally, the, or each, reference feature is arranged at the fixed end of the ink distribution support.

Optionally, the printhead integrated circuit is formed from a silicon wafer.

Optionally, the ink distribution support is a molding formed from liquid crystal polymer.

Optionally, the liquid crystal polymer of the ink distribution support has thermal expansion characteristics similar to those of the silicon of the printhead integrated circuit.

Optionally, the, or each, printhead integrated circuit has at least 6400 nozzles.

Optionally, the printhead assembly comprises 32000 nozzles spanned over the, or each, printhead integrated circuit.

In a further aspect there s provided a printing cartridge, the printhead assembly comprises five printhead integrated circuits which are arranged to span a pagewidth.

Optionally, the pagewidth is 100.9 millimeters.

In a seventh aspect the present invention provides a method of priming an inkjet printhead, the inkjet printhead having a plurality of ink ejection nozzles, the method comprising the steps of:

providing an ink bag containing ink for distribution to the nozzles via a fluid path between the ink bag and the nozzles;

applying inwardly directed force on at least one exterior wall of the ink bag so as to reduce an available fluid volume of the ink bag, thereby causing ink to flow from the ink bag to the nozzles along the fluid path; and arranging a biasing member in the ink bag so that the biasing member applies outwardly directed force on at least one interior wall of the ink bag so as to restrain the reduction of available fluid volume of the ink bag only once the available fluid volume of the ink bag has been reduced to a predetermined volume.

Optionally, the biasing member incorporates a leaf spring.

Optionally, the leaf spring is made from a material having shape-memory characteristic.

Optionally, the material is Mylar.

Optionally, the leaf spring is formed by folding an elongate arcuate piece of the material about an approximate centre line orthogonal to the longitudinal extent thereof so that the leaf spring exhibits an outwardly directed spring restoring force.

Optionally, the leaf spring is formed so as to have a folded longitudinal length and radius of curvature which result in the leaf spring being able to float within the ink contained in the ink bag prior to the application of the inwardly directed force by the force applicator.

Optionally, the ink bag is configured to have an available fluid volume of at least 19 milliliters.

Optionally, the predetermined available fluid volume is at least 15 milliliters.

Optionally, the ink bag is configured to have an available fluid volume of at least 23 milliliters.

Optionally, the fluid path connects the ink bag to at least 6400 nozzles of the printhead.

Optionally, each nozzle of the printhead is configured to eject an ink drop having a volume of about 1.2 picoliters.

Optionally, the nozzles of the printhead are arranged so as to print at a resolution of 1600 dots per inch.

Optionally, the ink bag contains one of magenta ink, cyan ink and yellow ink.

Optionally, the printhead is a pagewidth printhead, having a pagewidth of 100.9 millimeters.

In an eighth aspect the present invention provides an ink supply arrangement for an inkjet printhead, the inkjet printhead having a plurality of ink ejection nozzles, the ink supply arrangement comprising:

at least one ink bag containing ink for distribution to the nozzles via a fluid path between the ink bag and the nozzles, the ink being primed in the fluid path and nozzles so as to be ejected by the nozzles, in use, thereby depleting the ink contained in the ink bag, the ink bag being configured to collapse as the ink is depleted;

a body for housing the ink bag and the printhead, the ink bag being attached to the body at a wall opposite a wall of the ink bag facing the printhead; and a biasing member arranged in the ink bag to apply outwardly directed force on at least the wall of the ink bag facing the printhead, wherein the biasing member is configured to maintain substantially constant negative pressure at the nozzles as the ink is depleted from the ink bag.

Optionally, the biasing member incorporates a compression spring.

Optionally, the compression spring has a free length equal to the height from the attached wall of the ink bag to the nozzles plus a height of a negative ink head necessary to provide said negative pressure.

Optionally, the free length is 141 millimeters and the height from the attached wall of the ink bag to the nozzles is 41 millimeters.

Optionally, said walls of the ink bag have an area of 30 millimeters by 50 millimeters and the compression spring has a spring constant of 14.7 Newtons per meter.

Optionally, the compression spring is made of stainless steel.

Optionally, the body is incorporated in a printhead cartridge.

Optionally, the printhead cartridge is removably engageable with a printer.

Optionally, the non-collapsed ink bag has a fluid volume of at least 15 milliliters.

Optionally, the fluid path connects the ink bag to at least 6400 nozzles of the printhead.

Optionally, each nozzle of the printhead is configured to eject an ink drop having a volume of about 1.2 picoliters.

Optionally, the nozzles of the printhead are arranged so as to print at a resolution of 1600 dots per inch.

In a further aspect there is provided an ink supply arrangement, comprising three of said ink bags.

Optionally, a first ink bag contains magenta ink, a second ink bag contains cyan ink and a third ink bag contains yellow ink.

Optionally, the fluid path of the first ink bag connects the first ink bag to 12800 nozzles of the printhead, the fluid path of the second ink bag connects the second ink bag to 12800 nozzles of the printhead, and the fluid path of the third ink bag connects the third ink bag to 6400 nozzles of the printhead.

Optionally, the printhead has 32000 nozzles.

Optionally, the printhead is a pagewidth printhead, having a pagewidth of 100.9 millimeters.

Optionally, the printhead comprises 5 linked printhead integrated circuits arranged to span the pagewidth, each printhead integrated circuit having 6400 nozzles arranged in rows.

Optionally, the fluid path of each ink bag connects the respective ink bag to at least two nozzle rows of each printhead integrated circuit.

Optionally, the fluid path of first ink bag connects the first ink bag to four nozzle rows of each printhead integrated circuit, the fluid path of second ink bag connects the second bag to four nozzle rows of each printhead integrated circuit, and the fluid path of third ink bag connects the third ink bag to two nozzle rows of each printhead integrated circuit.

In a ninth aspect the present invention provides an inkjet printhead cartridge, comprising:

an inkjet printhead having a plurality of ink ejection nozzles;

at least one ink bag containing ink for distribution to the nozzles via a fluid path between the ink bag and the nozzles, the ink being primed in the fluid path and nozzles so as to be ejected by the nozzles, in use, thereby depleting the ink contained in the ink bag, the ink bag being configured to collapse as the ink is depleted;

a body for housing the ink bag and the printhead, the ink bag being attached to the body at a wall opposite a wall of the ink bag facing the printhead; and a biasing member arranged in the ink bag to apply outwardly directed force on at least the wall of the ink bag facing the printhead, wherein the biasing member is configured to maintain substantially constant negative pressure at the nozzles as the ink is depleted from the ink bag.

Optionally, the biasing member incorporates a compression spring.

Optionally, the compression spring has a free length equal to the height from the attached wall of the ink bag to the nozzles plus a height of a negative ink head necessary to provide said negative pressure.

Optionally, the free length is 141 millimeters and the height from the attached wall of the ink bag to the nozzles is 41 millimeters.

Optionally, said walls of the ink bag have an area of 30 millimeters by 50 millimeters and the compression spring has a spring constant of 14.7 Newtons per meter.

Optionally, the compression spring is made of stainless steel.

Optionally, the body is arranged to be removably engageable with a printer.

Optionally, the printer comprises a print controller for operating the nozzles of the printhead, said operation causing ink ejection and the depletion of ink from the ink bag.

Optionally, the non-collapsed ink bag has a fluid volume of at least 15 milliliters.

Optionally, the fluid path connects the ink bag to at least 6400 nozzles of the printhead.

Optionally, each nozzle of the printhead is configured to eject an ink drop having a volume of about 1.2 picoliters.

Optionally, the nozzles of the printhead are arranged so as to print at a resolution of 1600 dots per inch.

In a further aspect there is provided an inkjet printhead cartridge, comprising three of said ink bags.

Optionally, a first ink bag contains magenta ink, a second ink bag contains cyan ink and a third ink bag contains yellow ink.

Optionally, the fluid path of the first ink bag connects the first ink bag to 12800 nozzles of the printhead, the fluid path of the second ink bag connects the second ink bag to 12800 nozzles of the printhead, and the fluid path of the third ink bag connects the third ink bag to 6400 nozzles of the printhead.

Optionally, the printhead has 32000 nozzles.

Optionally, the printhead is a pagewidth printhead, having a pagewidth of 100.9 millimeters.

Optionally, the printhead comprises 5 linked printhead integrated circuits arranged to span the pagewidth, each printhead integrated circuit having 6400 nozzles arranged in rows.

Optionally, the fluid path of each ink bag connects the respective ink bag to at least two nozzle rows of each printhead integrated circuit.

Optionally, the fluid path of first ink bag connects the first ink bag to four nozzle rows of each printhead integrated circuit, the fluid path of second ink bag connects the second bag to four nozzle rows of each printhead integrated circuit, and the fluid path of third ink bag connects the third ink bag to two nozzle rows of each printhead integrated circuit.

An embodiment of a printhead cartridge that incorporates features of the present invention is now described by way of example with reference to the accompanying drawings.

BRIEF DESCRIPTION OF THE DRAWINGS

In the drawings:

FIGS. 25 and 25A illustrate reference features of the printhead cartridge; and FIGS. 26, 26A, 26B and 26C illustrate alignment of the printhead cartridge with the printer.

DETAILED DESCRIPTION OF EMBODIMENTS

Figure 1:
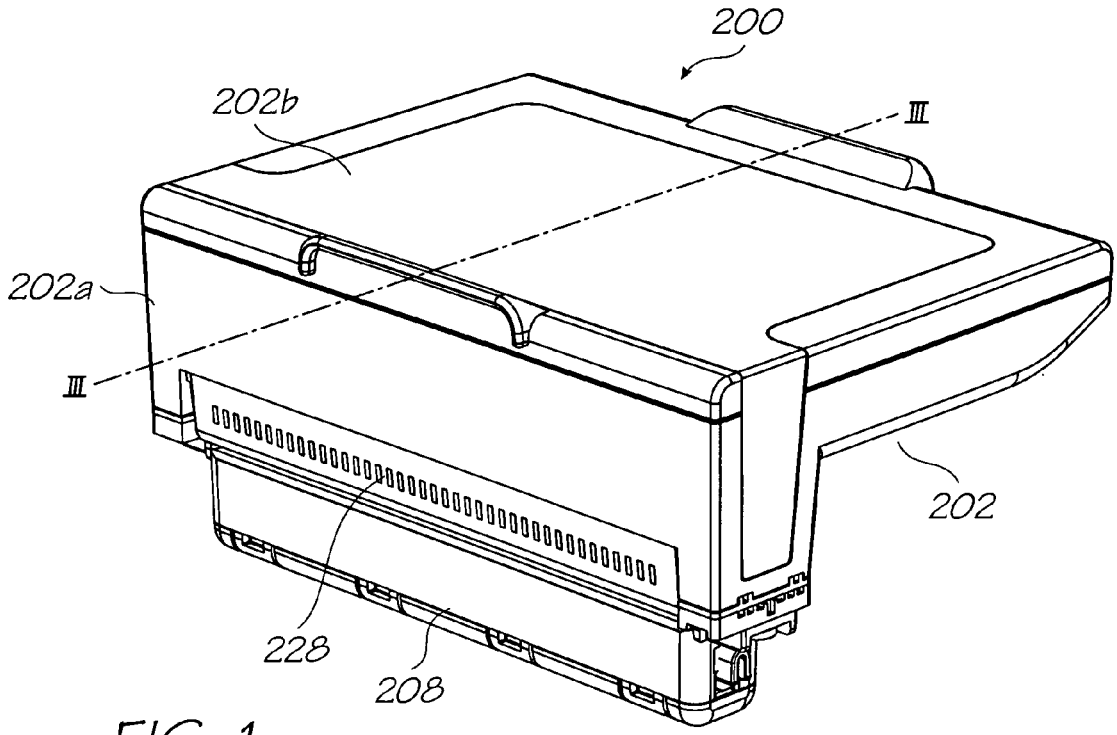
FIG. 1 shows a top elevational perspective view of a printhead cartridge of a printer.

A printer 100 is provided which is intended for use as a digital photo color printer and is dimensioned to print 100 millimeter by 150 millimeter (4 inch by 6 inch) photos whilst being compact in size and light in weight. As will become apparent from the following detailed description, reconfiguration and dimensioning of the printer could be carried out so as to provide for other printing purposes.

The printer 100 of the illustrated photo printer embodiment has dimensions of 18.6 cm (W); 7.6 cm (H); 16.3 cm (D), and a weight of less than two Kilograms. The compact and lightweight design of the printer provides portability and ease of use.

The printer 100 may be easily connected to a PC via USB (such as a USB 1.1 port for USB 2.0 compatible PCs) and to digital cameras and other digital photo equipment, such as electronic photo albums and cellular telephones, via USB or PictBridge. Direct printing is available when using Pictbridge compatible digital photo equipment. This enables quick and convenient printing of digital photo images.

Connection to external power is used, preferably to mains power via a 12 Volt; 2 Amp (or 24 Volt; 1 Amp) DC power converter. However, the printer may be configured to operate from an internal power source. The printer is configured to efficiently use power, operating at a maximum power consumption of 36 Watts.

The printer 100 has three core components: a printhead cartridge 200 having a printhead and ink supply; a printer or cradle unit 400 which supports the printhead cartridge and has a media transport mechanism for transporting print media past the printhead; and a media supply cartridge 600 for supplying the media to the printer.

The present invention is concerned with the printhead cartridge 200, and therefore detailed description of the cradle unit and media supply cartridge is not provided herein. A full description of a suitable cradle unit and media supply cartridge for use with the printhead cartridge 200 is described in the Applicant's simultaneously co-filed U.S. Patent Applications (currently identified by their Docket Numbers, which will be substituted once U.S. Serial Numbers are known) Ser. Nos. 11/293,794, 11/293,839, 11/293,826, 11/293,829, 11/293,830, 11/293,827, 11/293,828, 11/293,795, 11/293,823, 11/293,824, 11/293,831, 11/293,815, 11/293,819, 11/293,818, 11/293,817 and Ser. No. 11/293,816, the entire contents of which are hereby incorporated by reference.

The printhead cartridge 200 is an assembly having the necessary components for operation as a printer when mounted to the printer or cradle unit having a media supply.

Figure 4:
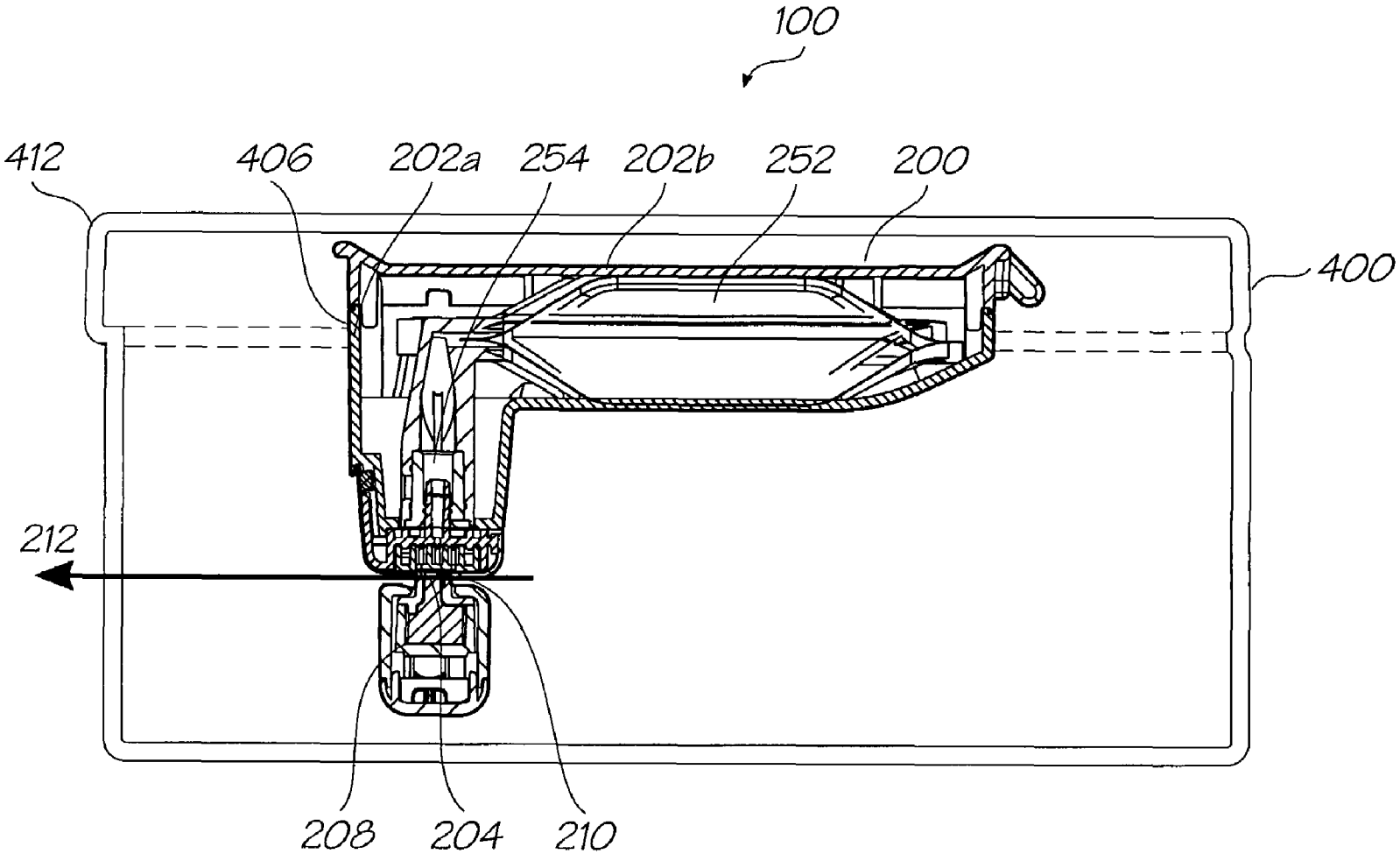
FIG. 4 shows a cross-sectional view of the printer taken along the line I-I of FIG. 3.
Figure 5:
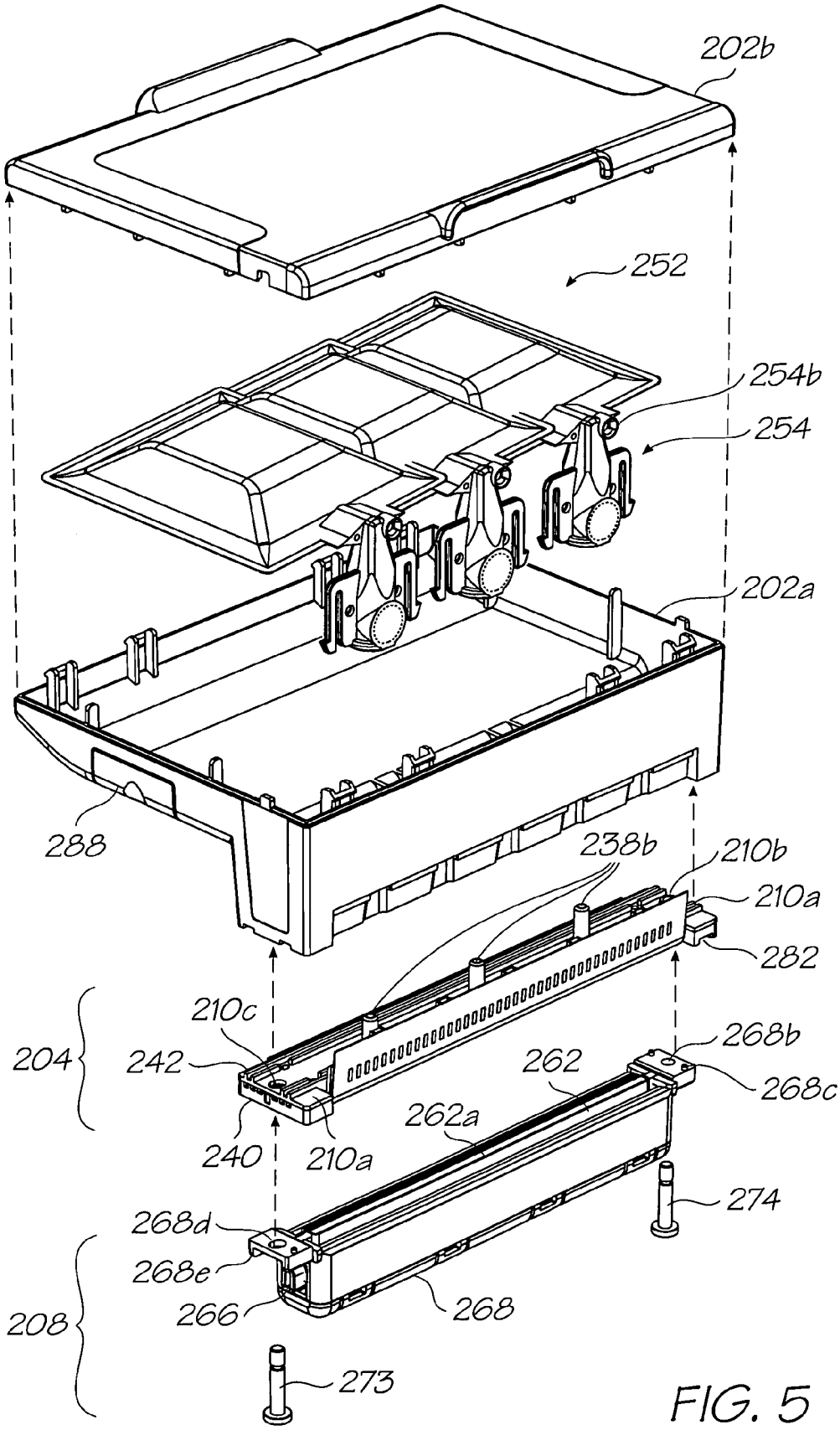
FIG. 5 shows an exploded view of the printhead cartridge.

The printhead cartridge 200 has a body 202 which is shaped to fit securely in a complementarily shaped printhead cartridge 200 support of the cradle unit (see FIGS. 1 and 4). The body 202 of printhead cartridge 200 houses a printhead 204 and an ink supply 206 for supplying ink to the printhead 204 and has a capper 208 for capping the printhead 204 when the printhead 204 is not in use.

The printhead 204 comprises an ink distribution support 210 which is used to mount the printhead 204 to the printhead cartridge body 202 and distribute ink from the ink supply 206 arranged in the body 202 to the printhead 204. The capper 208 is also mounted to the printhead cartridge body 202 via the ink distribution support 210 so as to be located beneath the mounted printhead 204 relative to the ink supply 206. A media path 212 (see arrow of FIG. 4) is formed between the printhead 204 and the capper 208 for the transport of print media past the printhead 204 when the capper 208 is not capping the printhead 204.

In the illustrated embodiment, the printhead is a pagewidth inkjet printhead. By using a pagewidth printhead it is unnecessary to scan the printhead across print media. Rather, the printhead remains stationary with the print media being transported therepast for printing. By operating the printhead to continuously print as the print media is continuously fed past the printhead (so called 'printing-on-the-fly'), the need to stall the media feed for each print line is obviated, therefore speeding up the printing performed.

The printer incorporating the printhead 204 of the printhead cartridge 200 is configured to print a full colour page in at most two seconds, which provides high-speed printing of about 30 pages per minute. This high speed printing is performed at high quality as well, with a resolution of at least 1600 dots per inch being provided by the printhead. Such a high resolution provides true photographic quality above the limit of the human visual system.

This is achieved by forming the printhead from thousands of ink ejection nozzles 214 across the pagewidth, e.g., about 100 millimeters for 4 inch by 6 inch photo paper. In the illustrated embodiment, the printhead incorporates 32,000 nozzles. The nozzles 214 are preferably formed as Memjet™ or microelectomechanical inkjet nozzles developed by the Applicant. Suitable versions of the Memjet™ nozzles are the subject of a number of the applicant's patent and pending patent applications, the contents of which is incorporated herein by cross reference and the details of which are provided in the cross reference table above.

Brief detail of a printhead suitable for use in the printhead cartridge 200 is now provided. The printhead is formed as a 'linking printhead' 216 which comprises a series of individual printhead integrated circuits (ICs) 218. A full description of the linking printhead, its control and the distribution of ink thereto is provided in the Applicant's co-pending U.S. application Ser. Nos. 11/014,769, 11/014,729, 11/014,743, 11/014,733, 11/014,754, 11/014,755, 11/014,765, 11/014,766, 11/014,740, 11/014,720, 11/014,753, 11/014,752, 11/014,744, 11/014,741, 11/014,768, 11/014,767, 11/014,718, 11/014,717, 11/014,716, 11/014,732, and 11/014,742, all filed Dec. 20, 2004 and U.S. application Ser. Nos. 11/097,268, 11/097,185, 11/097,184, all filed Apr. 4, 2005 and the entire contents of which are incorporated herein by reference. In the illustrated embodiment, the linking printhead 216 has five printhead ICs 218 arranged in series to create a printing zone 219 of a 100.9 millimeter pagewidth.

Figure 7:
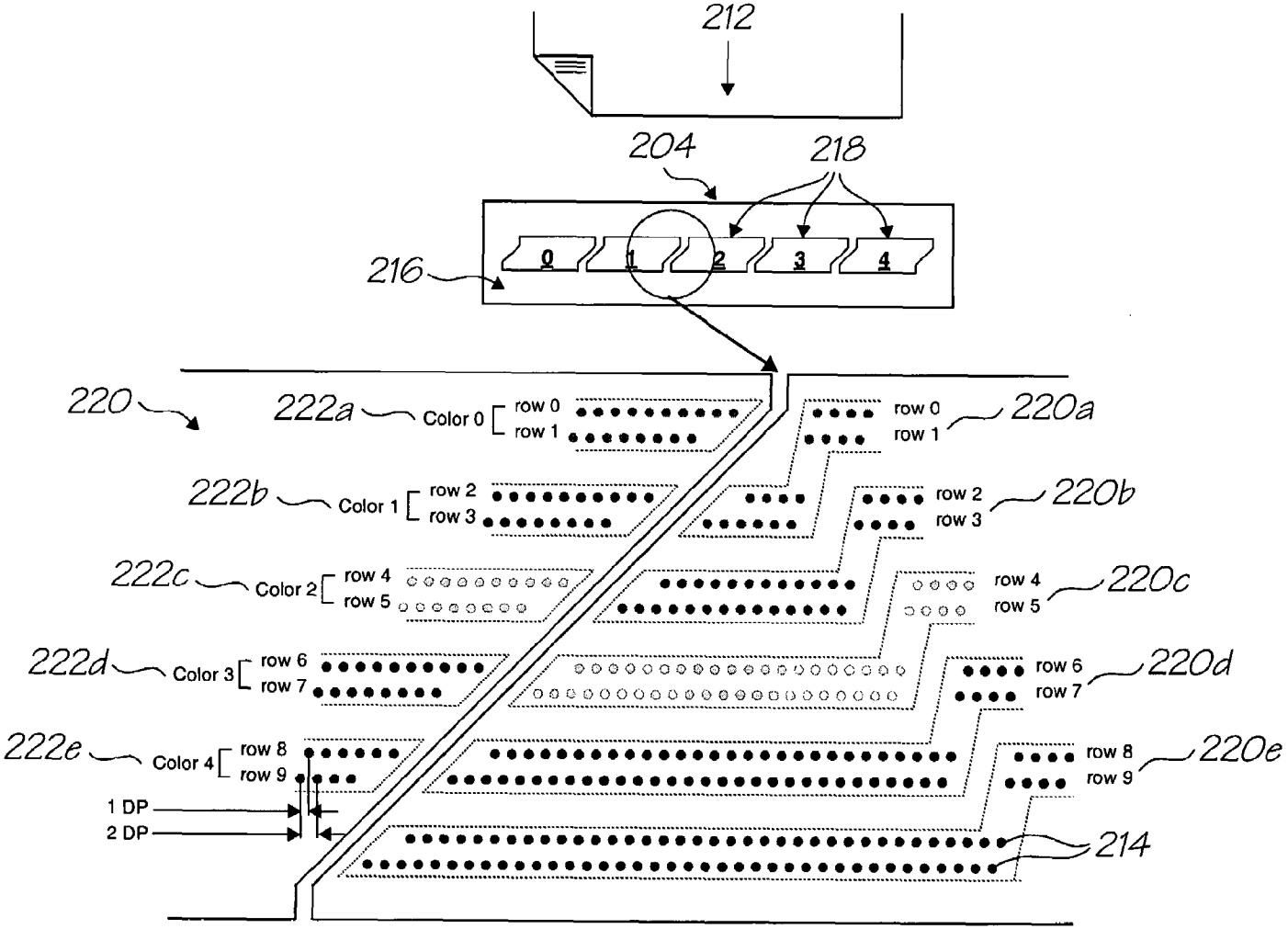
FIG. 7 illustrates an arrangement of printhead integrated circuits of the printhead.

Each printhead IC incorporates a plurality of nozzles 214 positioned in rows 220 (see FIG. 7). The nozzle rows 220 correspond to associated ink colours to be ejected by the nozzles 214 in that row 220. The illustrated embodiment has ten such rows 220 arranged in groups of two adjacent rows 220*a-e* for five colour channels 222*a-e*. However, other arrangements may be used. In the illustrated arrangement, each printhead IC has 640 nozzle per row, 1280 nozzles per colour channel, 6400 nozzles per IC and therefore 32000 nozzles for the five ICs of the printhead. Of course, a different number of printhead ICs, including less or more than five printhead ICs may be used.

Figure 8:
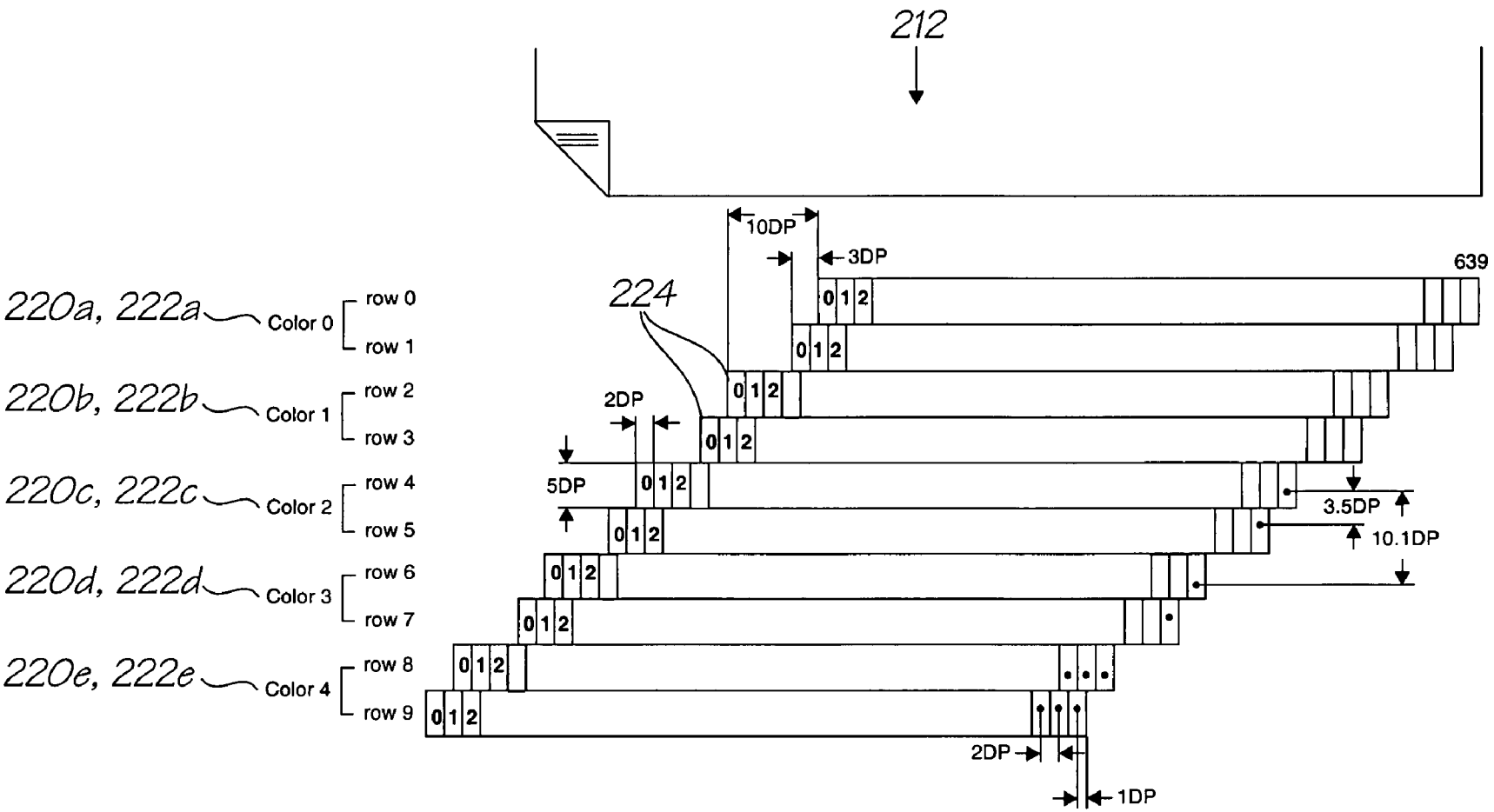
FIG. 8 illustrates an arrangement of ink ejection nozzles of the printhead integrated circuits.

The nozzles 214 are arranged in terms of unit cells 224 containing one nozzle 214 and its associated wafer space. In order to provide the print resolution of 1600 dots per inch, an ink dot pitch (DP) of 15.875 microns is required. By setting each unit cell to have dimensions of twice the dot pitch wide by five times the dot pitch high and arranging the unit cells 224 in a staggered fashion as illustrated in FIG. 8, this print resolution is achieved.

Figure 9:
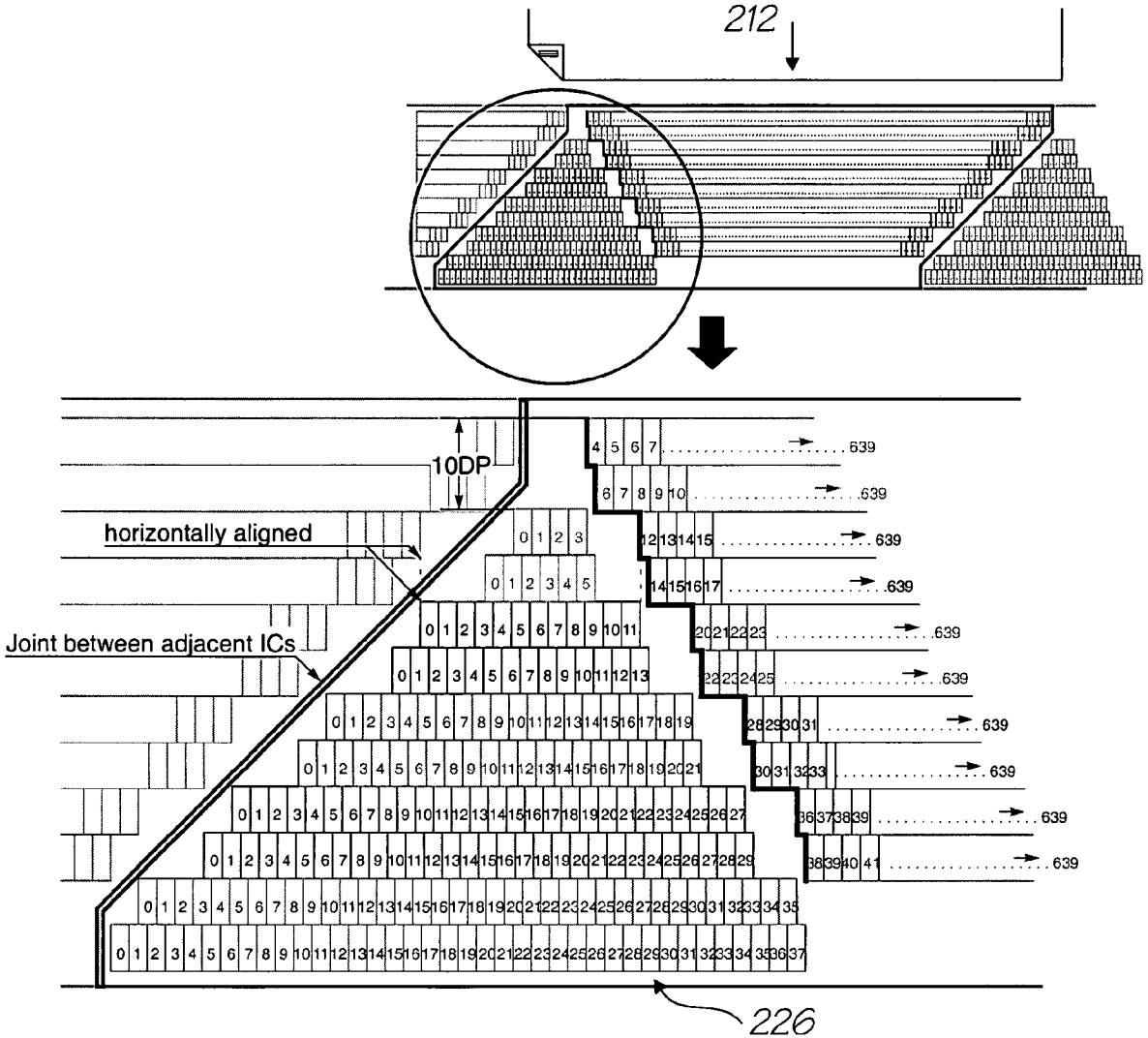
FIG. 9 illustrates a nozzle triangle of the printhead.

Due to this necessary staggered arrangement of the nozzles 214 discontinuity is created at the interface between the adjacent printhead ICs 218. Such discontinuity will result in discontinuity in the printed product causing a reduction in print quality. Compensation of this discontinuity is provided by arranging a triangle 226 of nozzle unit cells 224 displaced by 10 dot pitches at the interface of each adjacent pair of printhead ICs 218 (see FIG. 9).

The nozzle triangles 226 allow the adjoining printhead ICs 218 to be overlapped which allows continuous horizontal spacing between dots across the multiple printhead ICs 218 along the printhead and therefore compensates for any discontinuity. The vertical offset of the nozzle triangle 226 is accounted for by delaying the data for the nozzles 214 in the nozzle triangle 226 by 10 row times. The serially arranged nozzles rows 220 and nozzle triangles 226 of the printhead ICs 218 together make up the printing zone 219 of the printhead.

The transfer of data and power to the printhead nozzles is controlled by print control circuitry of the cradle unit when the printhead cartridge 200 is inserted therein. Connection of power and data is made to the printhead 204 via engagement and electrical connection of a connection interface of the cradle unit and a connection panel 228 of the printhead cartridge 200 (see FIGS. 1 and 4).

Figure 10:
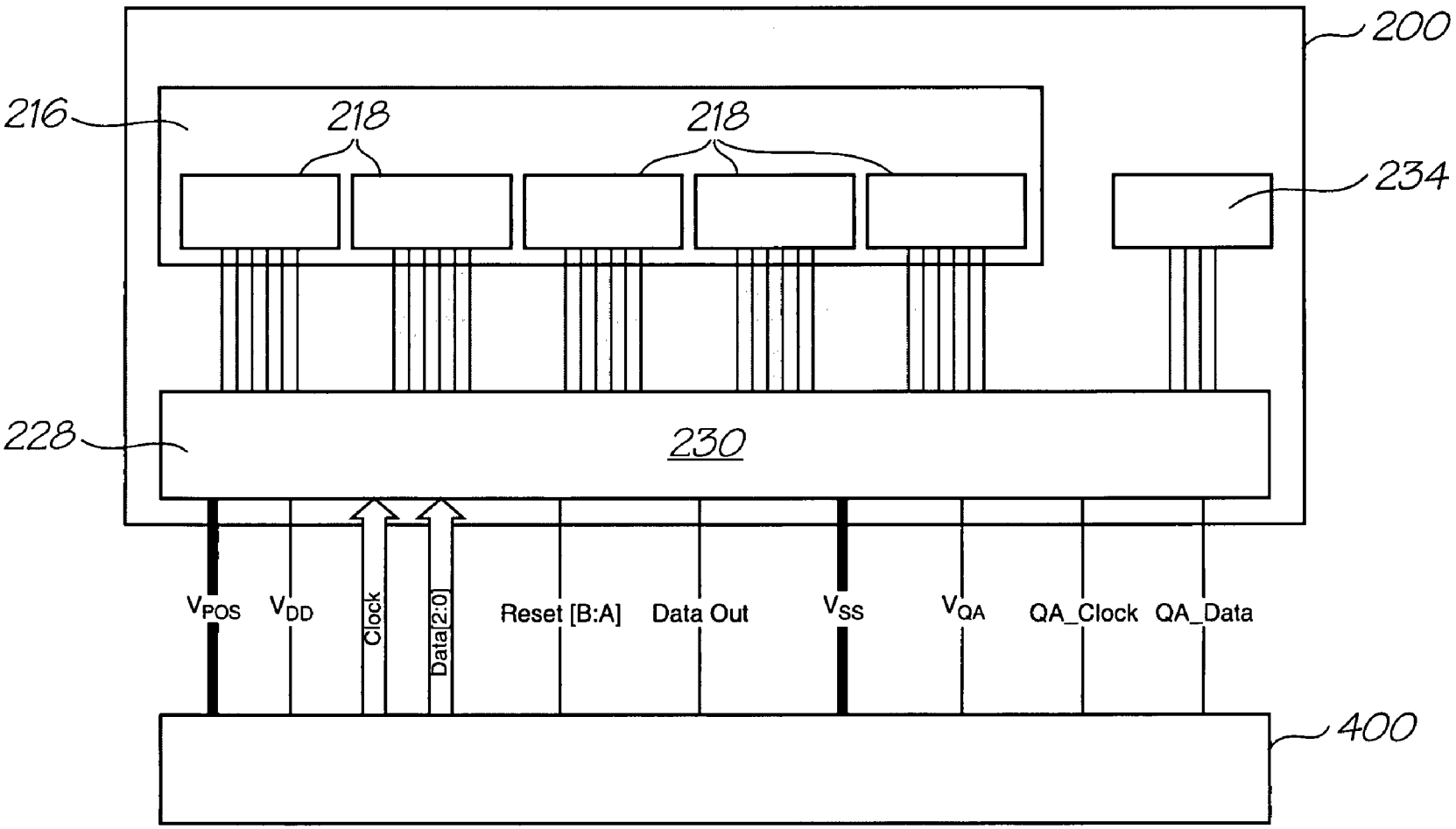
FIG. 10 illustrates data and power connections between the printhead cartridge and a cradle unit of the printer.

The connection panel 228 comprises a plurality of electrical contacts 230 positioned on a flexible printed circuit board 232. The flexible printed circuit board 232 is mounted to the ink distribution support 210 so as to wrap around one longitudinal edge thereof to expose the electrical contacts 230 to the connection interface of the cradle unit and to connect the contacts to the nozzles of the printhead 204 (see FIGS. 6 and 13). The specific connections made between the printer/cradle unit and the printhead 204 are illustrated in FIG. 10. In the illustrated embodiment, 40 contacts are provided in the connection panel at a pitch of 2.54 millimeters. The power ($V_{POS}$) and data delivered via these contacts is bussed to pins of the printhead ICs 218 and a quality assurance (QA) chip 234 of the printhead cartridge 200. The QA chip 234 is provided for ink quality assurance and defines technical compatibility between the printhead cartridge 200 and printer/cradle unit.

The QA chip 234 is configured to track usage of the nozzles, the number of prints that have been performed by the printhead cartridge 200 and the amount of ink remaining in the ink supply 206. This information is used to ensure that the printhead cartridge 200 is only used by a predetermined usage model. Such a usage model limits the use-lifetime of the printhead cartridge 200 in order to maintain consistent print quality.

For example, the model may either be a page-limited model which sets the number of pages which can be printed using the printhead cartridge 200 (e.g., 200 photo pages) or an ink-limited model which sets a maximum number of pages that can be printed without depleting the ink of the (non-refillable) ink supply 206. In this way, the printhead cartridge 200 is caused to be operational within the operational lifetime of the printhead nozzles 214 and within the supply of ink for full colour printing. Other suitable models for ensuring consistent print quality may also be used.

The QA chip 234 may also be configured to store additional information related to the manufacture of the printhead cartridge 200, including manufacture date, batch number, serial number, manufacturing test results (e.g., a dead nozzle map), etc.

The print control circuitry of the cradle unit interrogates the QA chip 234 via the connection interface and connection panel to read all available information, and uses the results to control the operation of the printer.

In controlling the printhead, the print control circuitry controls the supply of firing power to the nozzles in order to control the ejection of ink onto the passing print media. Each nozzle is configured to eject an ink drop having a volume of about 1.2 picoliters and a velocity of about eight meters per second. In order to consistently eject drops having these parameters, the power routed to the printhead by the cradle unit is regulated at the connection interface. The regulated power is restricted to have variations of less than 100 milli-Volts in the 5.5 Volts; 3.5 Amp supplied to the printhead from the 12 Volt; 2 Amp power supply. Variations of this order have negligible effect on drop ejection and therefore the firing pulse width supplied by the print control circuitry can be constant.

Firing of the nozzles may also cause brief peaks in the current consumption. These peaks are accommodated by the inclusion of energy storage circuitry in the connection interface of the cradle unit. Further energy storage can also be provided on the printhead 204 in the form of decoupling capacitors 236 on the flexible printed circuit board 232 (see FIGS. 11 and 13).

Figure 11:
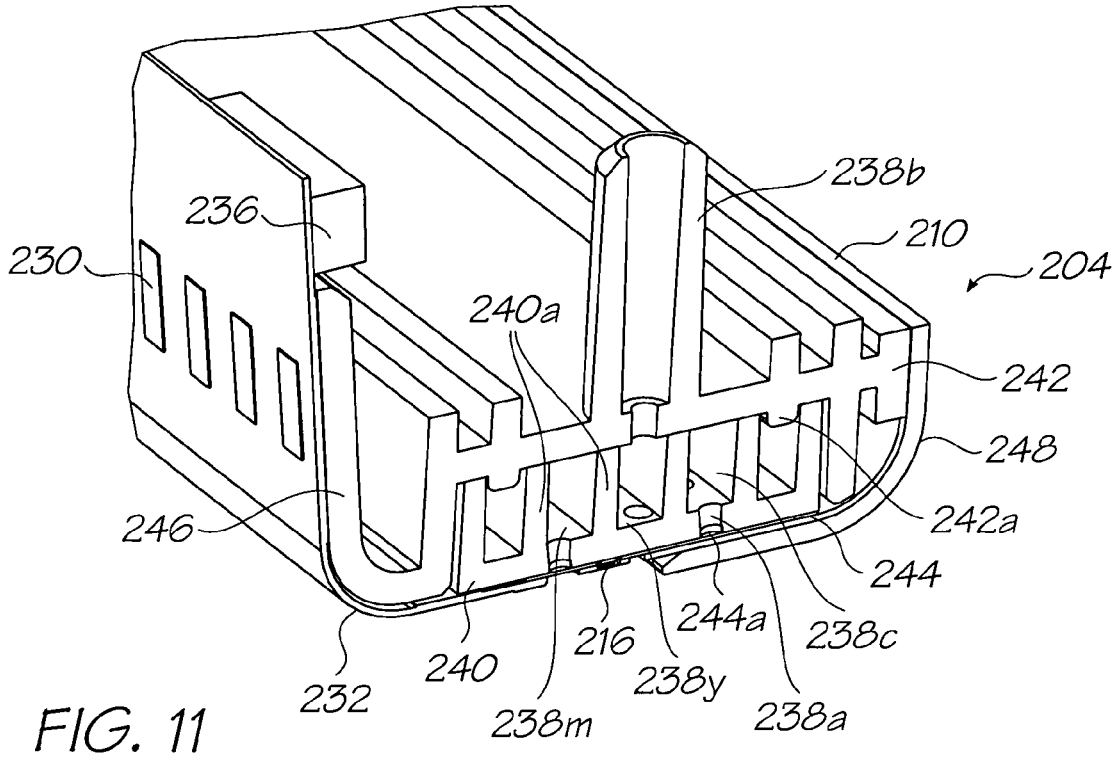
FIG. 11 shows a top elevational, partial cross-sectional view of the printhead taken about line II-II of FIG. 6.
Figure 12:
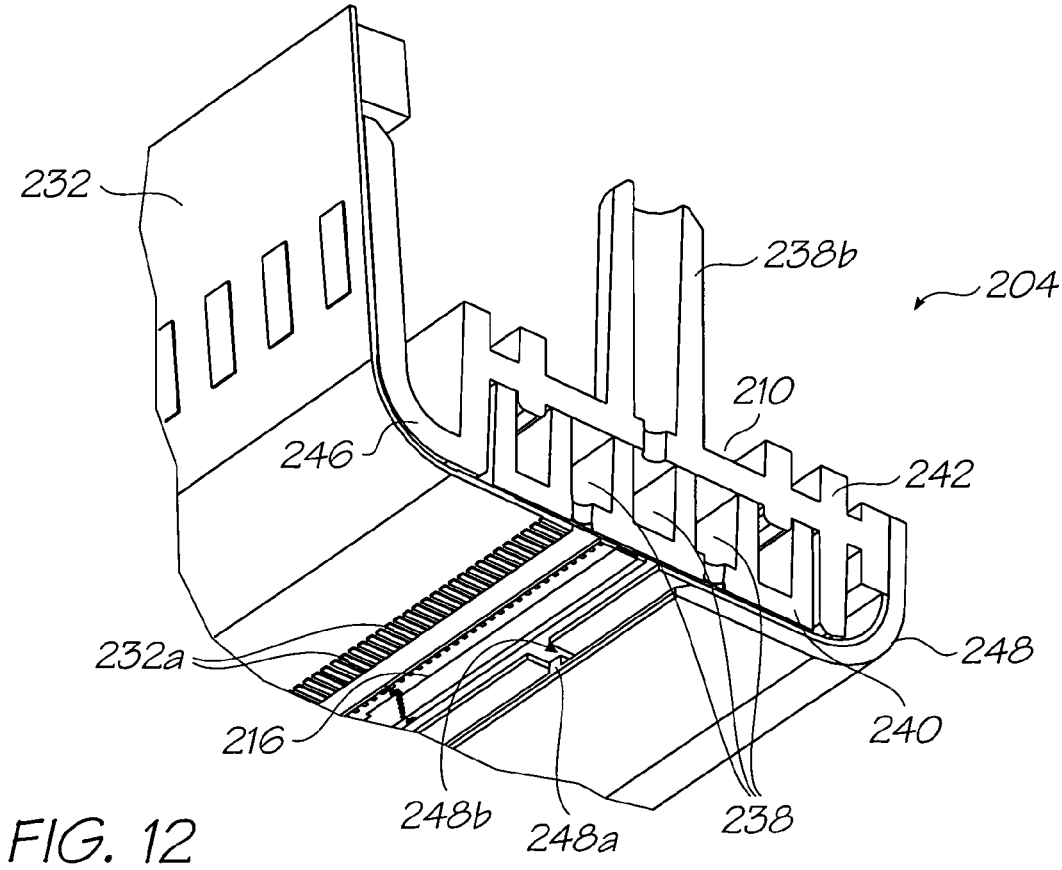
FIG. 12 shows a bottom elevational, partial cross-sectional view of the printhead taken about line II-II of FIG. 6.
Figure 13:
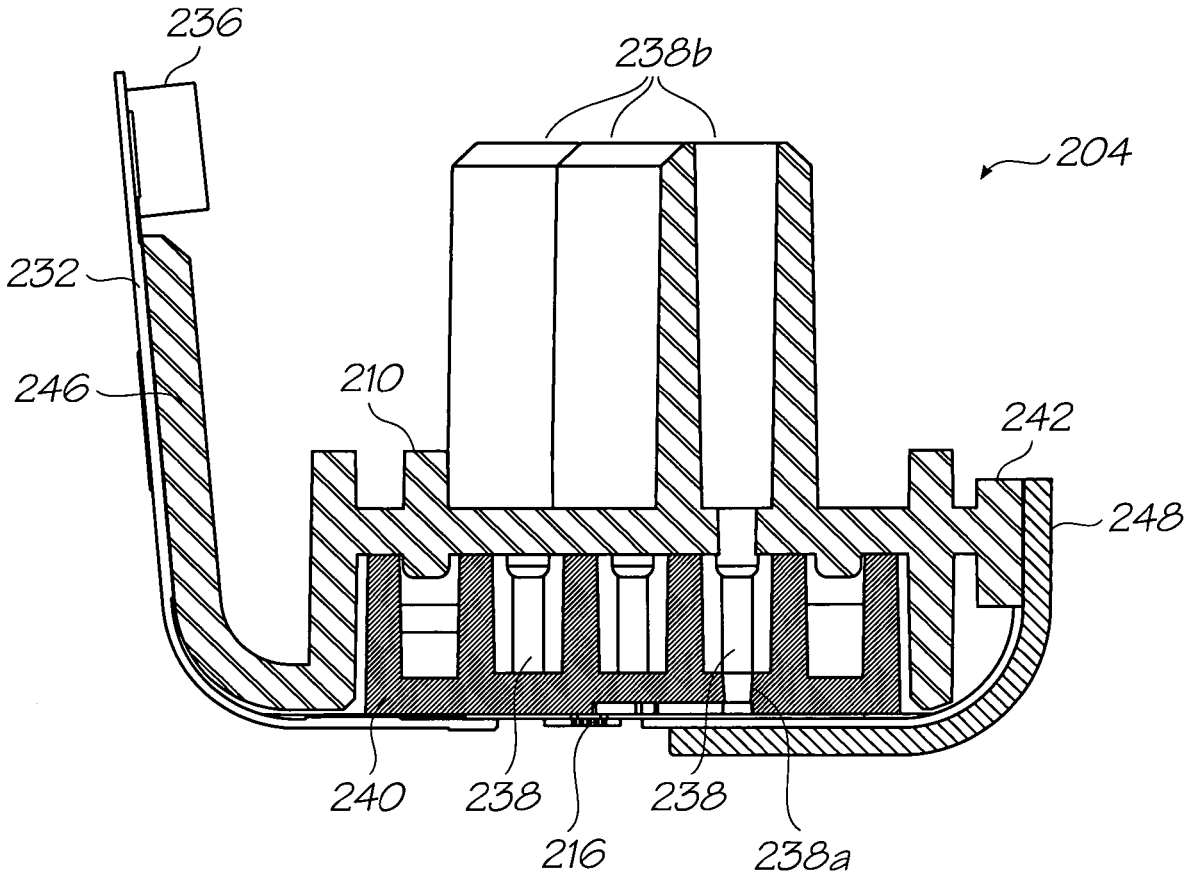
FIG. 13 shows a side cross-sectional view of the printhead taken about line II-II of FIG. 6.

As discussed earlier, five colour channels 222*a-e* are provided in the printhead 204. In the illustrated embodiment, the channels comprise two magenta ink channels, two cyan ink channels and one yellow ink channel. In order to distribute ink from the supply of the magenta, cyan and yellow inks to the nozzle rows, the ink distribution support 210 has three ink paths 238 as illustrated in FIGS. 11 to 13. The three ink paths 238 include a magenta ink path 238*m*, a cyan ink path 238*c* and a yellow ink path 238*y*.

The ink paths 238 are formed by the cooperation of an upper portion 240 and a lower portion 242 of the ink distribution support 210. The upper and lower portion 240,242 are preferably molded portions having details 240*a*,242*a* for forming the ink paths 238. Preferably, the upper and lower portion are molded from liquid crystal polymer, which is inert to the ink and can be configured to have thermal expansion characteristics similar to those of silicon which is used in the printhead ICs 218. The upper and lower portion 240,242 are bonded to one another to provide a seal for the ink paths 238.

The printhead 204 is an assembly of the ink distribution support 210 and the linking printhead 216 in which the linking printhead 216 is adhesively mounted to the ink distribution support 210 by a polymer sealing film 244. The sealing film 244 has a plurality of through-holes 244*a* which correspond to, and align, with conduits 238*a* from each of the ink paths 238 to the underside of the lower portion 242 of the ink distribution support 210 and associated ink delivery inlets in the underside of each printhead IC of the linking printhead 216. The sealing film 244 provides an effective seal between the ink path 238*a* and the printhead ink delivery inlets to prevent the wicking and mixing of ink between the different nozzle rows and individual nozzles. It is noted that the magenta and cyan ink paths 238*m* and 238*c* each have conduits 238*a* for feeding ink to two of the five colour channels of the linking printhead 216.

The flexible printed circuit board 232 is mounted to a flange 246 of the upper portion 240 of the ink distribution support 210 so that contact pads 232*a* of the flexible printed circuit board 232 are able to communicate data and power signals to each of the printhead ICs 218 via pads provided along one edge of the printhead ICs 218 (see FIGS. 12 and 13).

A media shield 248 is also mounted to the ink distribution support 210 along the opposite edge of the linking printhead 216 to the flexible printed circuit board 232. In the illustrated embodiment, the media shield 248 is mounted via an adhesive film 250, however other arrangements are possible. The media shield 248 is configured to maintain the passing media at a predetermined distance from the nozzles 214 of the linking printhead 216. This prevents damage being caused to the nozzles by contact of the media with the nozzles. The media shield 248 is preferably a molding formed of liquid crystal polymer. As can be seen from FIG. 12, the media shield 248 is spaced from the surface of the ink distribution support 210 by details 248*a*. A space 248*b* provided by the details 248*a* provides the predetermined distance of the print media from the nozzles 214.

Figure 14:
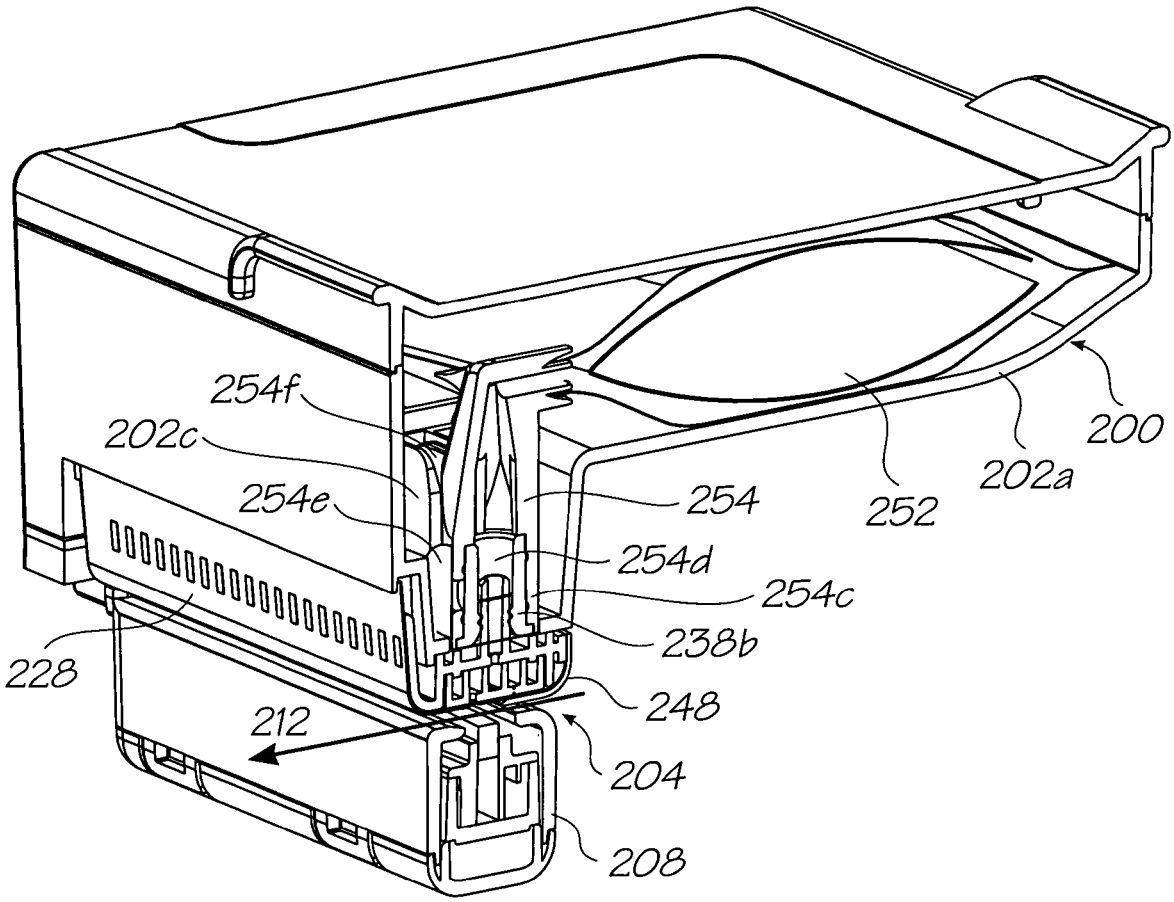
FIG. 14 shows a partial side cross-sectional view of the printhead cartridge taken about line III-III of FIG. 1.

In the illustrated embodiment, the ink-paths 238 of the ink distribution support 210 each have a conical or cylindrical inlet member 238*b* for fluid connection to an associated ink bag 252 of the ink supply 206 (see FIG. 14). Three ink bags 252 are provided, a magenta ink bag, a cyan ink bag and a yellow ink bag. The ink bags 252 are positioned in a base 202*a* of the body 202 of the printhead cartridge 200 which is enclosed by a lid 202*b*. The base and lid of the body are preferably plastics moldings having clip details for snap fitting the lid to the base.

Figure 15:
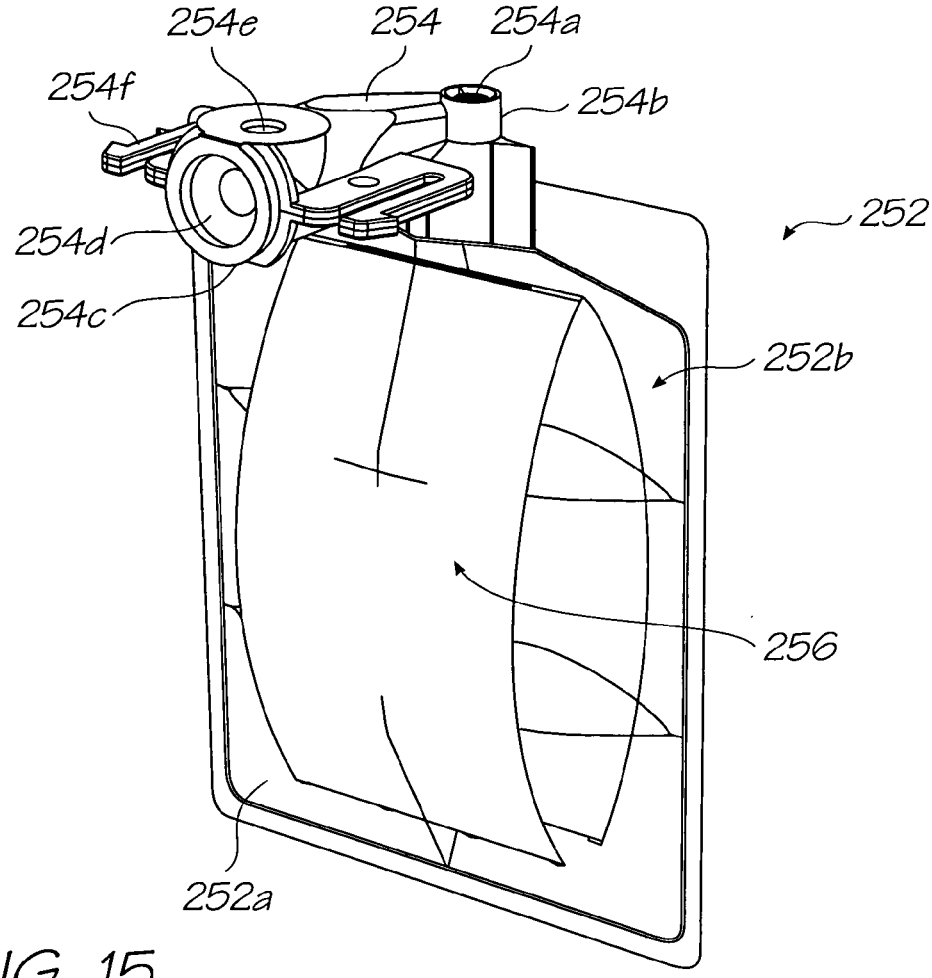
FIG. 15 shows an isolated view of an ink supply bag of the printhead cartridge.

One of the ink bags 252 is illustrated in FIG. 15. The ink bag is formed of two profiled panels 252*a* which are sealed together to make an ink holding chamber 252*b*. The ink holding chamber 252*b* of each ink bag is dimensioned to hold an ink volume of at least 19 milliliters up to about 23 milliliters and is configured to be collapsible so as to reduce the available ink volume. The sealed panels 252*a* seal about a connector assembly 254 and a folded leaf spring 256. The connector assembly 254 is used for both filling of the ink bag with the required ink volume during manufacture of the printhead cartridge 200 and connecting the ink bag 252 with the inlet member 238*b* of the respective ink path 238 of the ink distribution support 210.

Distribution of ink from the ink bag 252 to the ink paths 238 via the connector assembly 254 is performed through an outlet 254*c* of the connector assembly 254. The cylindrical outlet 254*c* is fitted with a coupling seal 254*d* which has ring details on the exterior cylindrical surface for preventing ink from leaking between the outlet's inner surface and the coupling seal, and ring details on the interior cylindrical surface for preventing ink from leaking between the coupling seal and the outer surface of the inlet member of the ink path (see FIG. 14).

Filling of the ink bag and priming of ink into the connector assembly 254 is performed by injecting ink into an access hole 254*e* of the connector assembly 254. Air within the ink bag/connector assembly is able to escape through an outlet 254*b* during filling. Once filled, a ball seal 254*a* seals the outlet 254*b* and the coupling seal 254*d*, which is provided with a cover seal (not shown), is positioned in the outlet 254*c* to seal off the access hole, as illustrated in FIG. 14. Air is undesired within the ink bag and connector assembly 254 so as to prevent air from entering the ink distribution support 210 and the nozzles 214. Air or other gases may cause printing problems due to the microscopic size of the nozzles. A suitable air filter (not shown) may also be incorporated within the connector assembly 254 to exclude any air present in the ink bag from entering the ink distribution system.

The connector assembly 254 is mounted within the interior of the cartridge body base 202*a* by engaging clips 254*f* of the connector assembly 254 with details 202*c* in the base 202*a* which sealingly engages the outlets of the connector assemblies with the inlet members 238*b* of the respective ink paths 238 (see FIG. 14).

Figure 17:
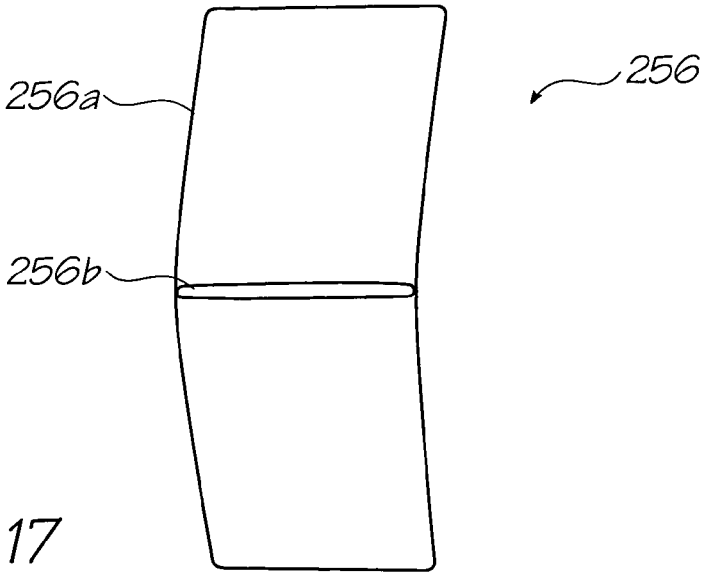
FIG. 17 illustrates the leaf spring unfolded.
Figure 16:
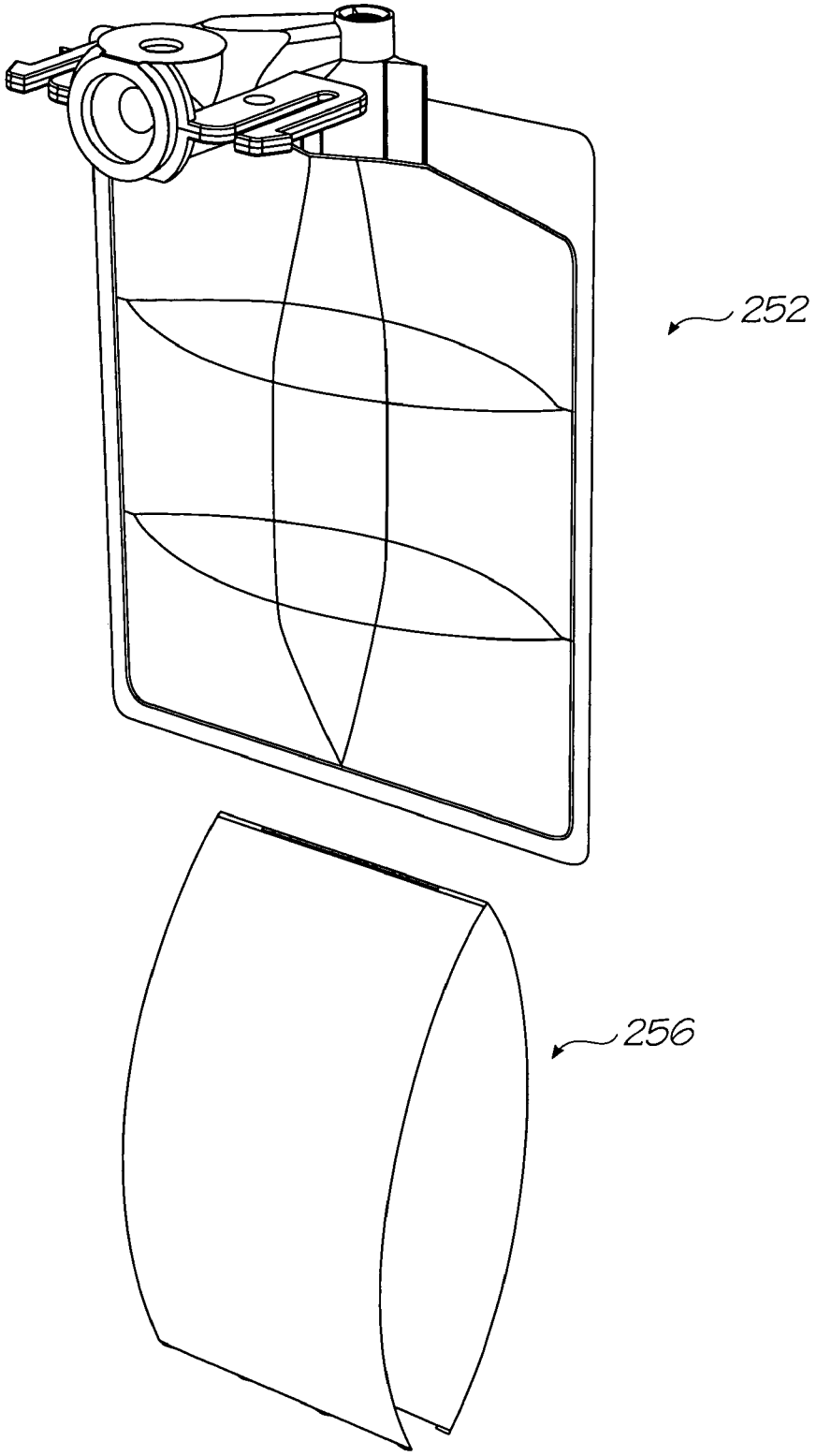
FIG. 16 illustrates a folded leaf spring as removed from the ink bag.

The folded leaf spring 256 of each bag 252 is formed by folding an elongate plate 256*a* about a centrally disposed slot 256*b* (see FIGS. 16 and 17). The elongate plate 256*a* is dimensioned so that when folded it fits within the sealed ink bag 252. The elongate plate 256*a* is formed so as to be resilient to the folding and the folding is performed so as to create a curvature in the folded plate. This creates a folded leaf spring which is resistant to an inwardly directed force and which in turn applies an outwardly directed force. A leaf spring having a spring constant equivalent to 1.2 Newtons across an eight millimeter distance between the faces is suitable. Mylar is a suitable material for the leaf spring for its shape memory characteristics. When Mylar is used the folded leaf spring may be thermally formed. Other spring materials may be used, such as stainless steel.

The use of the leaf springs 256 within the ink bags 252 provides negative fluid pressure at the nozzles of the printhead 204 when the ink bags 252 are connected to the nozzles and the ink has been fully primed to the nozzles from the ink bags 252. Negative fluid pressure is created by the leaf spring exerting outwardly directed force on the interior walls of the ink bag panels 252*a*. Negative fluid pressure is desired at the nozzles to ensure that uncontrolled ejection or leakage of ink from the nozzles does not occur.

A negative pressure head of about −100 millimeters is required to effectively prevent ink from leaking at the nozzles. The illustrated leaf springs 256 may cause fluctuations in the negative pressure head as ink is depleted from the ink bags 252 and therefore the ink volume decreases.

In an alternative embodiment, coil springs or like compression springs 258 may be used in place of the leaf springs 256. The use of a suitably configured compression spring 258 within the ink bag 252, and attachment of the ink bag 252 to the underside of the lid 202*b* of the cartridge body 202 with suitable adhesive, ensures that a constant negative pressure head is created at the nozzles independent of the ink volume in the ink bags 252. A suitably configured compression spring, for an ink bag of area 30 millimeters by 50 millimeters, is a spring having the required free length and a spring constant of 14.7 Newtons per meter.

Figure 18:
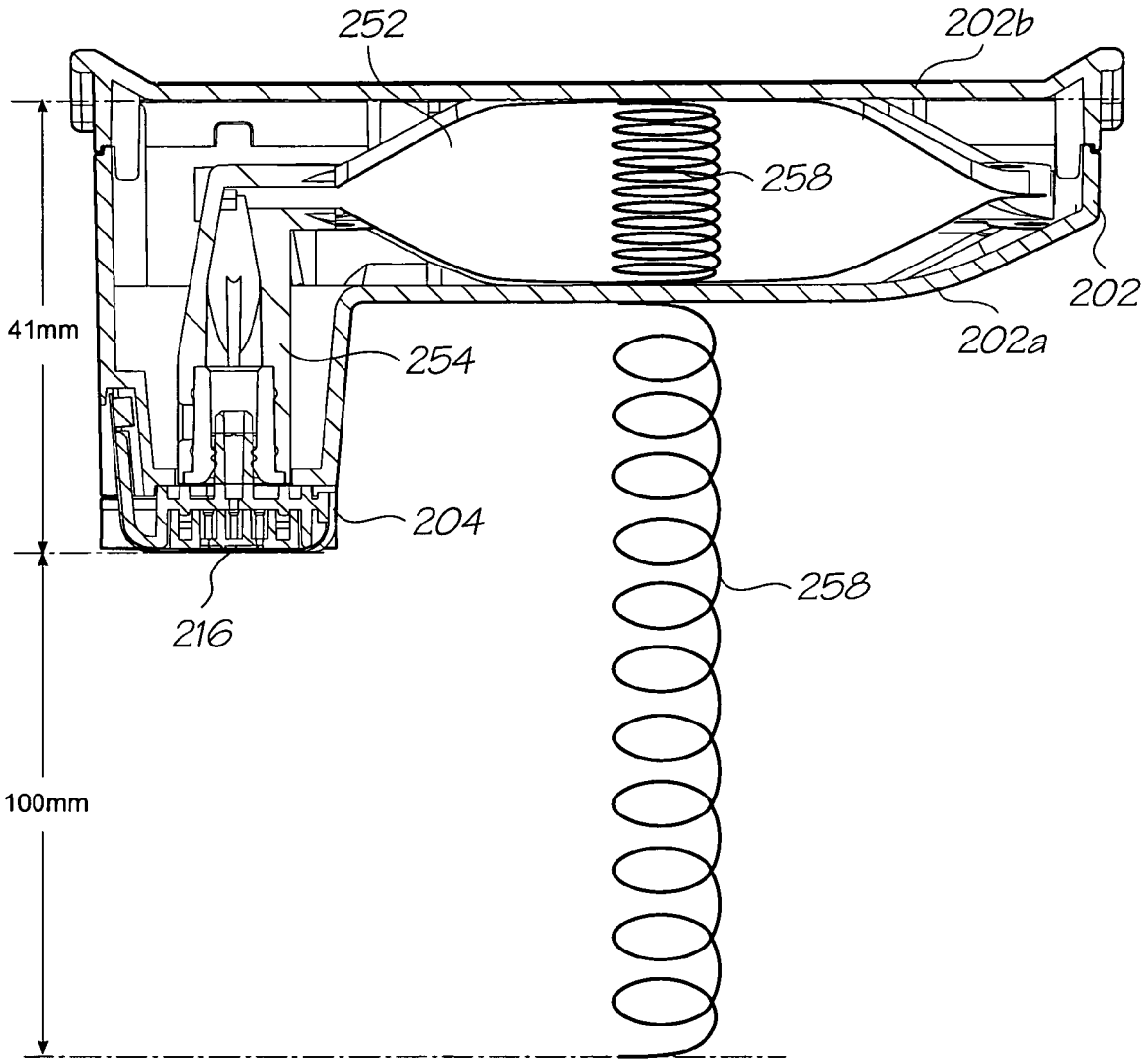
FIG. 18 illustrates an alternative biasing arrangement of the ink bag.

The required free length is a combination of a free length of 100 millimeters and the height of the printhead cartridge 200 (e.g., from the attached point of the top of the ink bag 252 to the ink ejection plane of the nozzles). In the illustrated embodiment, the printhead cartridge 200 has a height of 41 millimeters from the interior of the lid 202*b* to the nozzles of the printhead 204, resulting in a free length of 141 millimeters for the compression spring 258 (see FIG. 18).

In the present embodiment, the leaf springs 256 also facilitate the priming of ink from the ink bags 252 to the connected nozzles. Priming is performed before packaging of the printhead cartridge 200 for distribution, and ensures that ink is situated throughout the operational system thereby removing any air or particulate matter in the system prior to printing. In order to prime ink into each of the ink paths 238 of the ink distribution support 210 and nozzles 214, the ink bags 252 are effectively overfilled with ink. That is, the printing volume of ink within each ink bag is set to be less than a 19 milliliter volume. A priming volume of about four milliliters is needed from each ink bag for priming the system. Thus, a printing volume of at least 15 milliliters is provided in each ink bag.

In practice, an additional volume of up to four milliliters is made available in each ink bag in order to account for the inability of the ink bags to be completely collapsed due to the non-zero width of the fully folded (i.e., compressed) leaf spring.

Figure 19A:
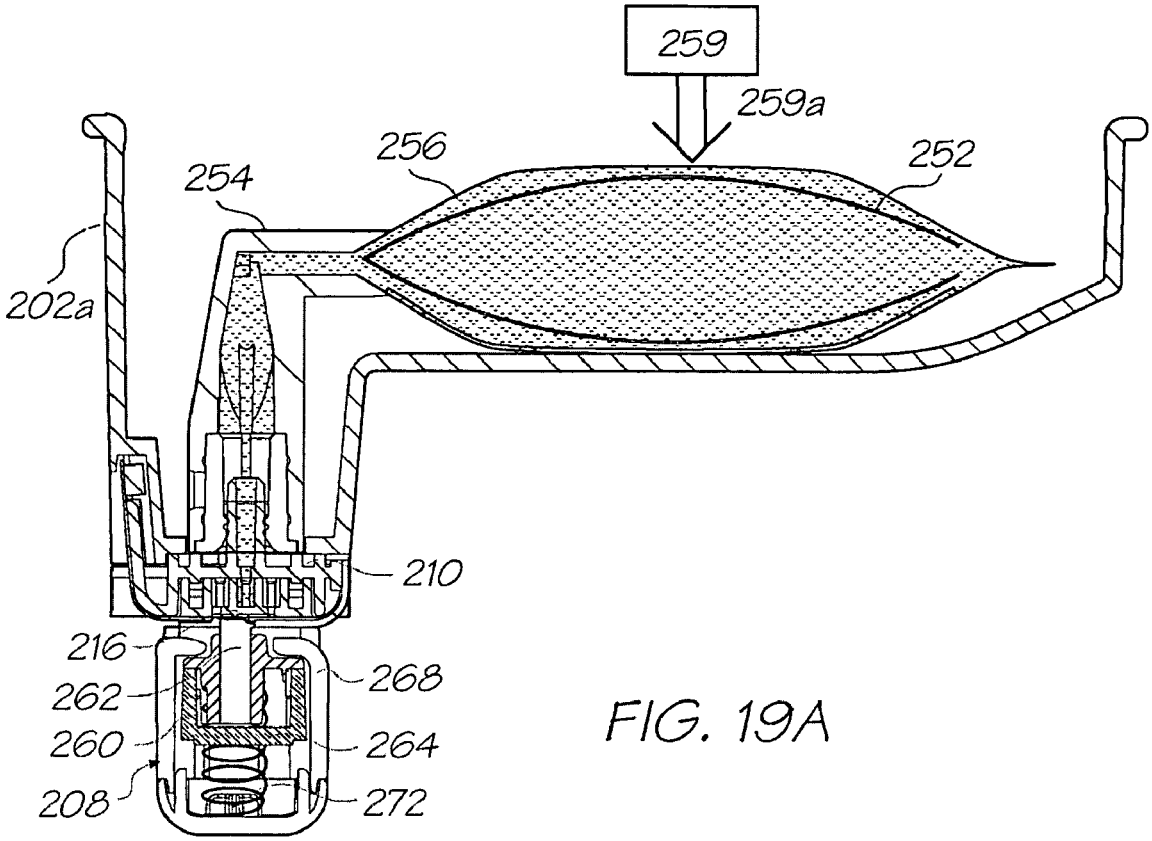
FIGS. 19A and 19B illustrate priming of ink into the printhead and a capping position of a capper of the printhead cartridge.

In order to prime the priming volume into the ink paths and nozzles, force is applied with a suitable force applicator 259 to the exterior surface of one or both panels 252*a* of the ink bags 252, as shown by arrow 259*a* in FIG. 19A. In order to provide effective priming, the folded leaf springs 256 are configured to contact the interior surfaces of the ink bags 252 only once the printing volume has been reached in the ink bag. That is, the leaf springs 256 effectively float within the overfilled ink bags 252 prior to priming being performed. The force applicator 259 is arranged to apply the inwardly directed priming force until the resistance caused by the outwardly directed force of the leaf spring is encountered, as shown by the arrows in FIG. 19B. In this way, negative pressure is immediately created at the primed nozzles.

Figure 19B:
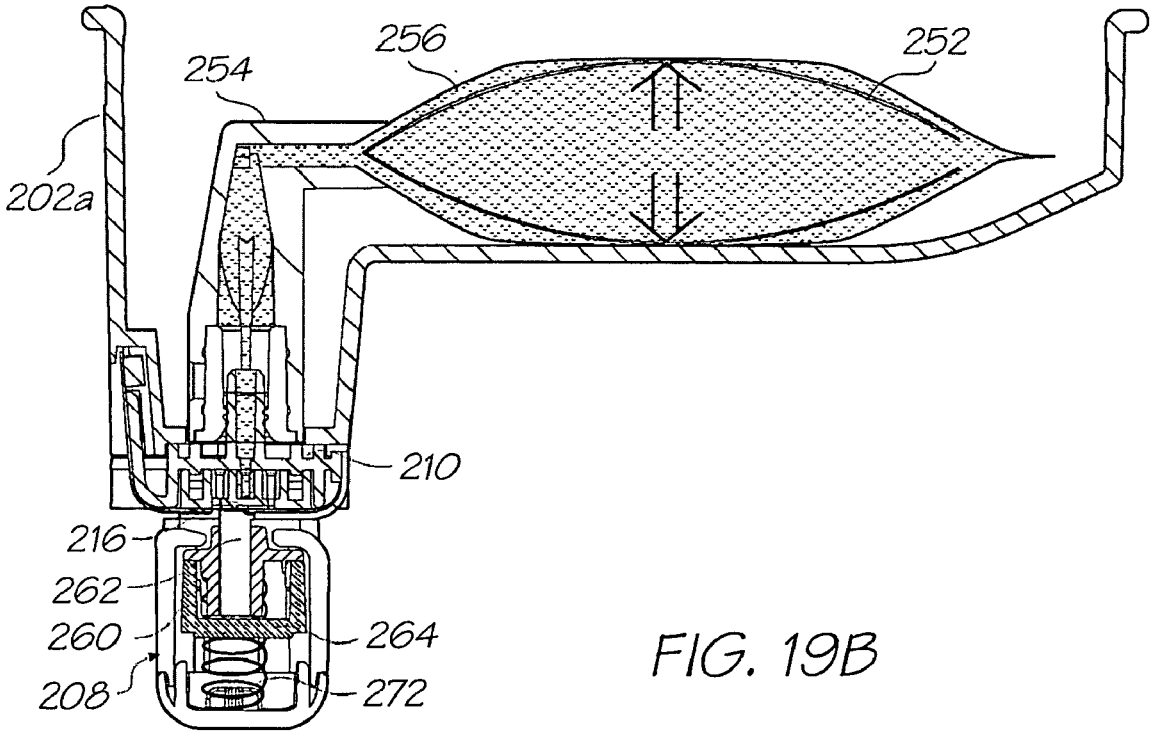
Figure 20:
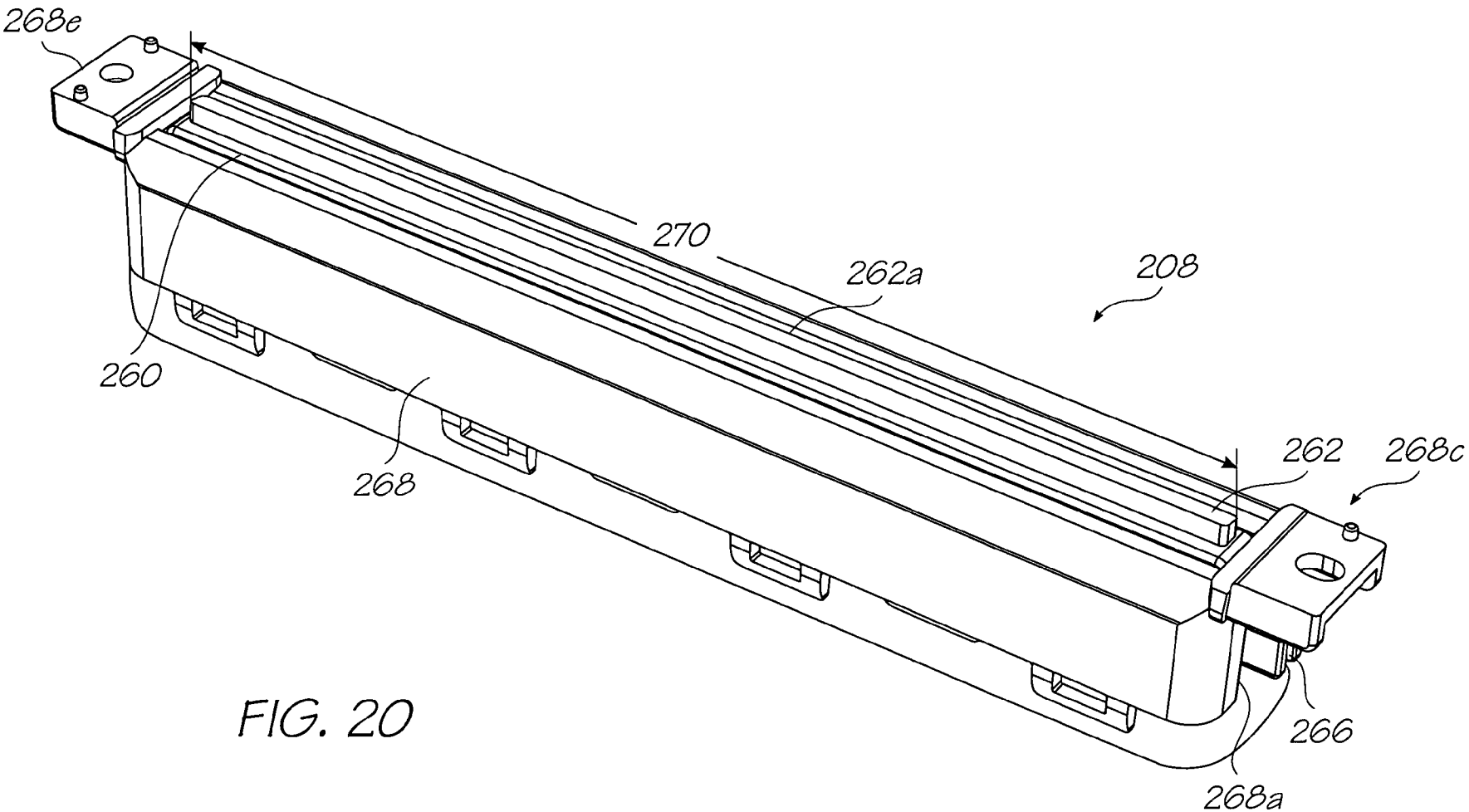
FIG. 20 shows an isolated view of the capper.

As illustrated in FIGS. 19A and 19B, a cap 260 of the capper 208 is at its capping position on the nozzles of the printhead 204 during the priming operation so as to capture any primed ink which is ejected from the nozzles during priming.

The manner in which the cap of the capper caps the printhead nozzles and the operation of the capper is described in the Applicant's co-pending U.S. patent application Ser. Nos. 11/246,676, 11/246,677, 11/246,678, 11/246,679, 11/246, 680, 11/246,681, and 11/246,714, all filed Oct. 11, 2005 and the entire contents of which are hereby incorporated by reference.

For ease of understanding, a brief excerpt of the description provided in these co-pending Applications is now provided.

Referring to FIGS. 19A to 22, the cap 260 of the capper 208 comprises an elastically deformable elongate pad 262 having a contact surface 262*a* mounted on a elongate support 264 which has lugs or actuation features 266 protruding from each longitudinal end. The support 264 is housed within an elongate housing 268 so that the lugs 266 protrude through slots 268*a* in the housing at each longitudinal end thereof. The housing is mounted to the ink distribution support 210 of the printhead 204 so as to align the pad 262 of the cap 260 with the printhead ICs 218 and the contact surface 262*a* of the pad 262 is configured to form a capping zone which is commensurate with the printing zone 219 of the printhead 204. Preferably the housing and support are formed as moldings from plastic or like material.

The support is slidably movable within the slots 268*a* of the housing 268, allowing the pad 262 to be slid relative to the housing 268. The extent of the pad's slidable movement is defined by the length of the slots 268*a* due to the contact of the lugs 266 with the slot walls. At the upper extent of movement, the cap 260 is placed in its capping position (see FIG. 21) and at the lower extent of movement, the cap 260 is placed in its non-capping position (see FIG. 22). The range of movement may be from about 1.5 millimeters to about 2.6 millimeters, thereby ensuring unobstructed passage of the print media along the media path 212.

Figure 22:
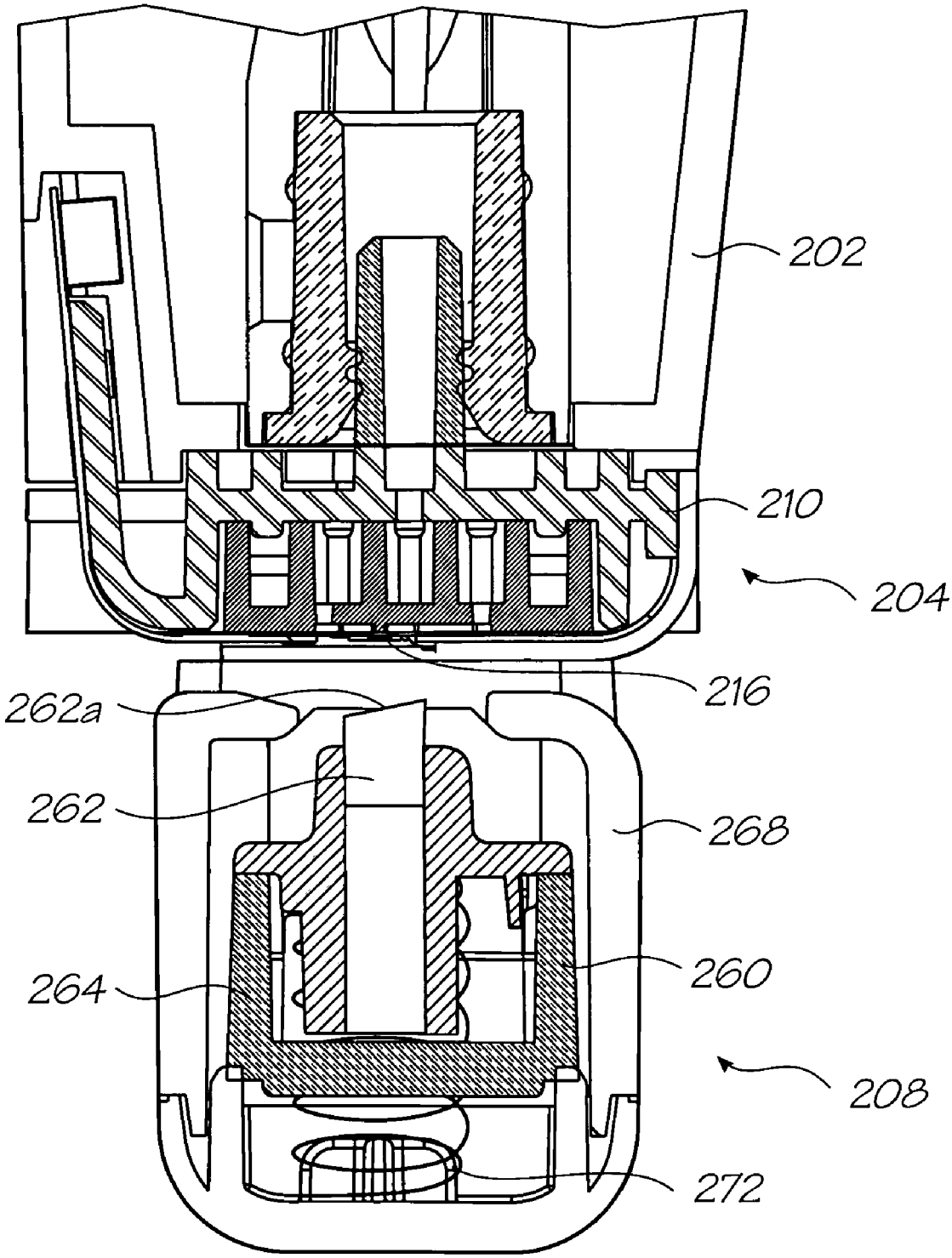
FIG. 22 illustrates a non-capping position of the capper.

A pair of springs 272 is fixed to the bottom wall of the housing 268 to bias the cap 260 into the capping position. In the capping position, the contact surface 262*a* of the pad 262, which defines the capping zone 270, sealingly engages with the nozzles 214 of the printhead 204 across the entire printing zone 219, thereby capping or covering the nozzles. This capping isolates the ink within the nozzles from the exterior, thereby preventing evaporation of water from the primed ink from the nozzles and the exposure of the nozzles to potentially fouling particulate matter during non-operation of the printhead. In the non-capping position, the contact surface 262*a* is disengaged from the nozzles, as illustrated in FIG. 22, allowing printing to be performed.

Figure 21:
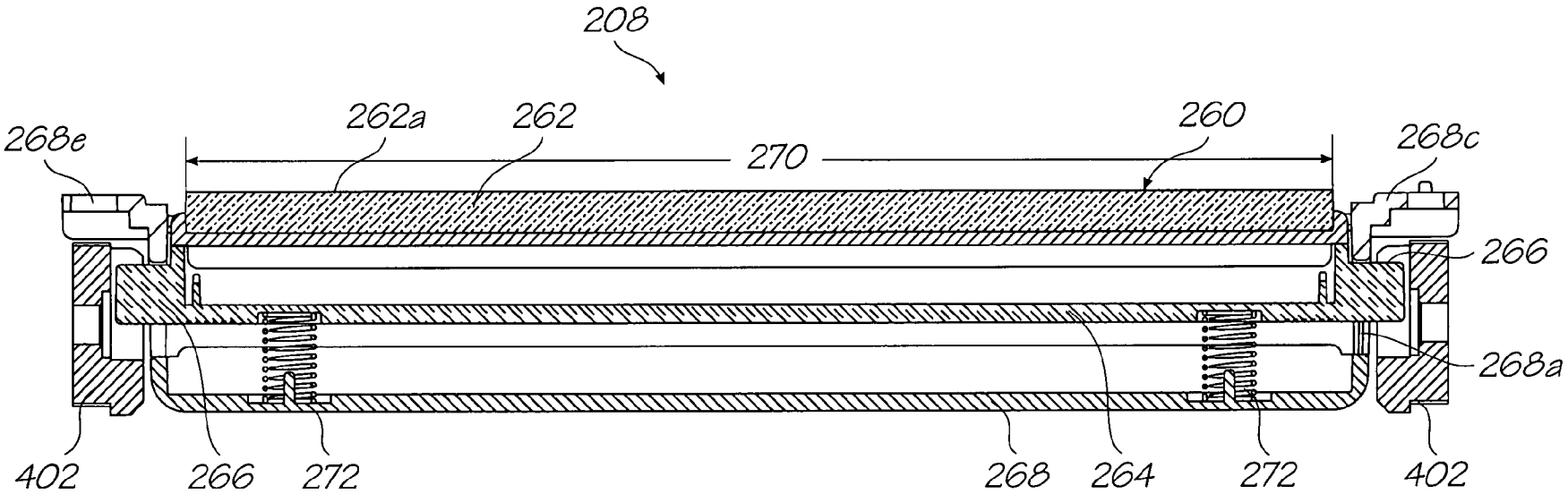
FIG. 21 shows a cross-sectional view of an operational arrangement of actuator features of the capper with a capping mechanism of the printer.

When the printhead cartridge 200 is mounted to the cradle unit 400, the lugs 266 of the support 264 engage with a cam 402 of a capping mechanism of the cradle unit 400, as illustrated in FIG. 21. Rotation of the cam 402, under control of the print control circuitry of the cradle unit 400, causes linear sliding movement of the support 264 and, hence, the pad 262, under control of the springs 272. Accordingly, the pad 262 may be moved reciprocally between its capping position and its non-capping position. The springs 272 are positioned to ensure that all parts of the contact surface 262*a* of the pad 262 move at the same rate with respect to the printhead 204.

By configuring the capper to be normally capping the printhead in its rest position, i.e., without requiring any electronic mechanism to hold the capper in its capping position, the potential of such an electronic mechanism failing, and therefore uncapping the printhead, is prevented.

As previously mentioned, the linking printhead 216 and capper 208 are commonly mounted to the body 202 of the printhead cartridge 200 via the ink distribution support 210. The ink distribution support 210 is mounted to the cartridge body 202 at mounting zones 210*a* of the support arranged at either longitudinal end of the printing zone 219 of the linking printhead 216 (see FIG. 6). The mounting zones 210*a* are formed as widened sections of the upper and lower portion 240,242 of the ink distribution support 210. These widened sections are easily molded as part of the upper and lower moldings.

Figure 23:
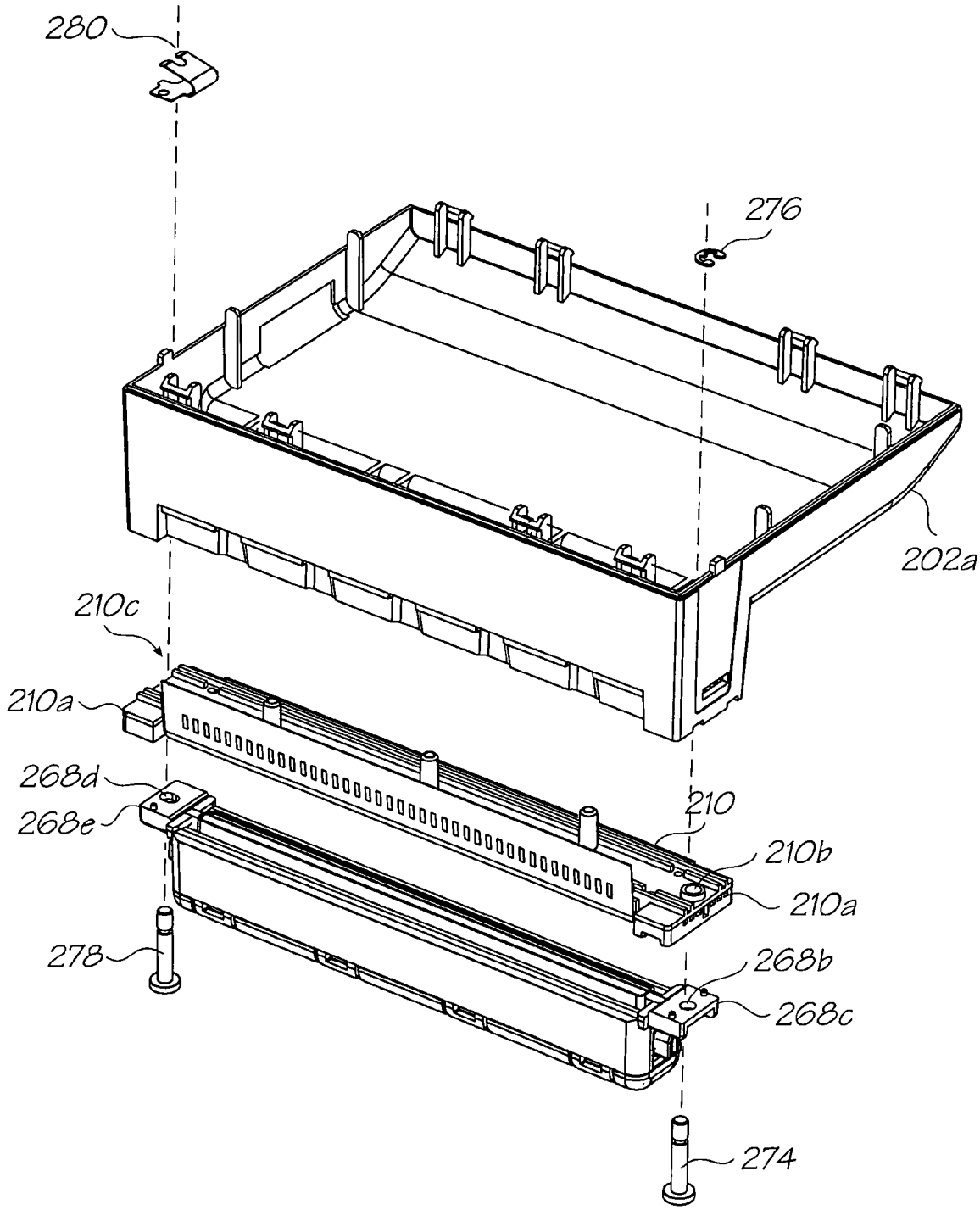
FIG. 23 illustrates assembly of the printhead and capper to a body of the printhead cartridge.

The mounting zone 210*a* at one end of the ink distribution support 210 (e.g., the right hand end as depicted in FIG. 23) is formed with a through-hole 210*b* which aligns with a corresponding through-hole 268*b* formed in a tab 268*c* extending from the capper housing 268, as illustrated in FIG. 23. These through-holes 210*b*,268*b* of the ink distribution support 210 and capper 208 further align with a similarly positioned through-hole (not shown) provided in the body 202 of the printhead cartridge 200.

The mounting zone 21 0*a* at the other end of the ink distribution support 210 (e.g., the left hand end as depicted in FIG. 23) is formed with a slot 210*c* (see FIG. 6) which aligns with a corresponding slot 268*d* formed in a tab 268*e* extending from the capper housing 268, as illustrated in FIG. 23. These slots 210*c*,268*d* of the ink distribution support 210 and capper 208 further align with a similarly positioned slot (not shown) provided in the body 202 of the printhead cartridge 200.

A pin 274 is passed through each of the aligned holes at the first end of the printing and capping zones and is locked in place so as to fix the printhead 204 and capper 208 to the cartridge body 202 by a locking member 276, such as a clip (e.g., an E-clip is illustrated).

A second pin 278 is passed through the aligned slots at the second end of the printing and capping zones and is locked in place with a biasing member 280. The biasing member 280 is arranged to bias the cartridge body 202, printhead assembly 204 and capper 208 together at the second pin 278 whilst allowing relative movement of the cartridge body 202, printhead assembly 204 and capper 208. The illustrated biasing member is a sprung clip 280, however other arrangements may be used.

Figure 24:
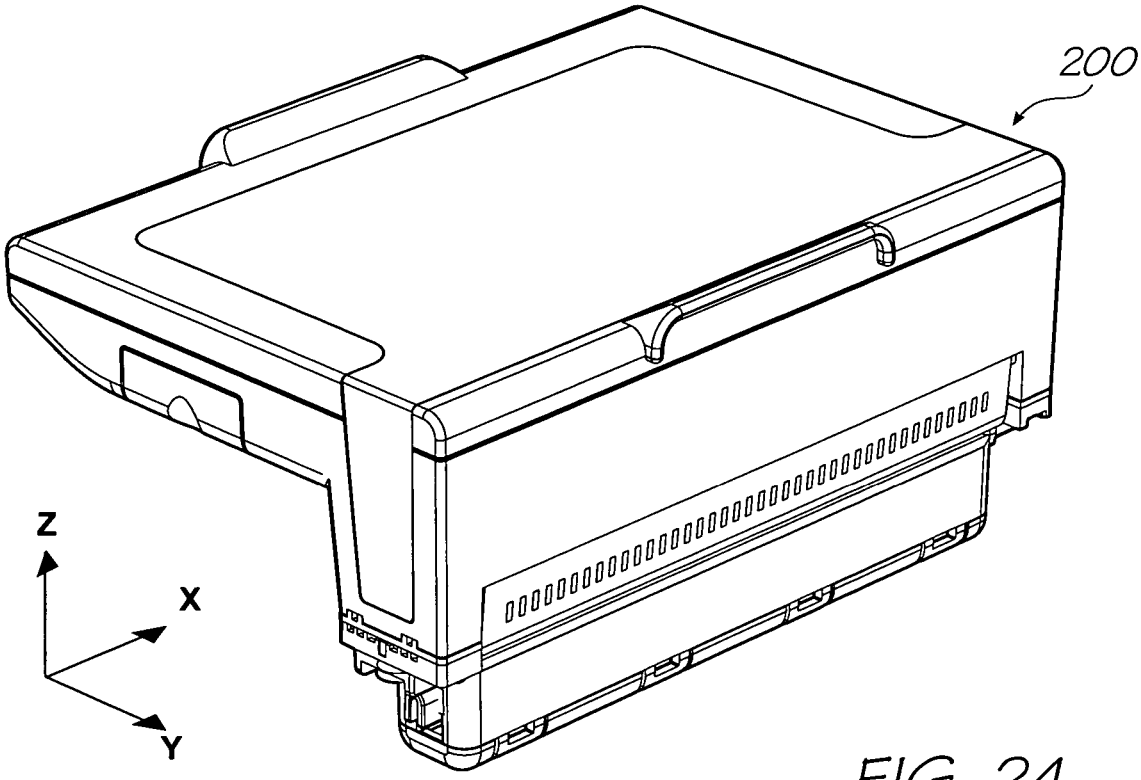
FIG. 24 illustrates a coordinate system of the printhead cartridge.

In this way, relative movement of the components of the printhead cartridge 200 is accommodated whilst maintaining a secure mount of, and proper alignment between, the components. In the illustrated embodiment, the slots are configured so as to accommodate movement along the longitudinal direction of the printhead 204 and capper 208 (i.e., in the X-direction of the coordinate system illustrated in FIG. 24). Such longitudinal movement may occur during the performance of printing due to thermal expansion of the linking printhead silicon and the ink distribution support liquid crystal polymer. As well as maintaining alignment, accommodating such thermal expansion alleviates the effect of stresses on the fragile printhead ICs.

Other slotted and/or confining arrangements are possible, so long as proper alignment of the components is maintained throughout the movement accommodated by these arrangements.

Whilst proper alignment of the printhead 204 and capper 208 are assured by the mounting arrangement, the exact position of the nozzles of the mounted printhead 204 must be known to perform high quality printing when the printhead cartridge 200 is inserted in the cradle unit 400. The requirement for this information is exacerbated by the small tolerances allowed by the 100.9 millimeter printing zone 219 of the linking printhead 216 for printing across the 100 millimeters of printable area of four inch wide photo paper.

This information is provided by the cooperation of X, Y and Z datums (in accordance with the coordinate system illustrated in FIG. 24) arranged as reference features of the printhead cartridge 200 with complementary mounting features of the cradle unit 400. A "datum" is defined as a reference position against which other features are located, within given tolerances.

In the illustrated embodiment, the three following key aspects of the printhead cartridge-cradle unit alignment are referenced to the X, Y and Z datums:

(1) the surface of the print media that the media transport mechanism of the printer presents to the printhead cartridge;

(2) the electrical contacts of the flexible printed circuit board on the printhead cartridge; and (3) the cartridge retention points used to hold the cartridge to the cradle unit.

The cooperation of the reference features of the printhead cartridge 200 and the mounting features of the printer is arranged to restrict the movement of the printhead cartridge 200, so as to keep within the tight tolerances.

Figure 6:
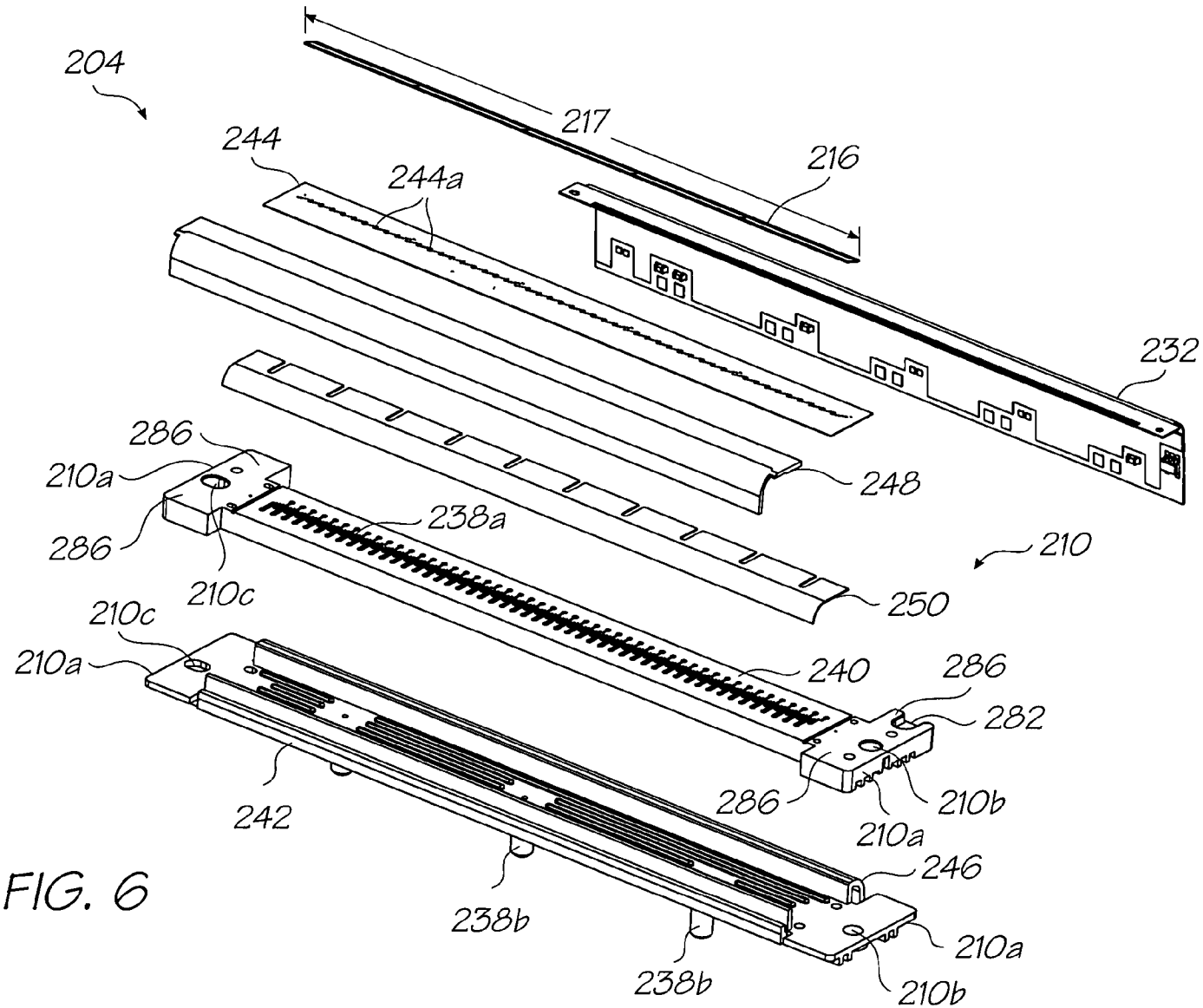
FIG. 6 shows an isolated view of a printhead of the printhead cartridge.
Figure 25:
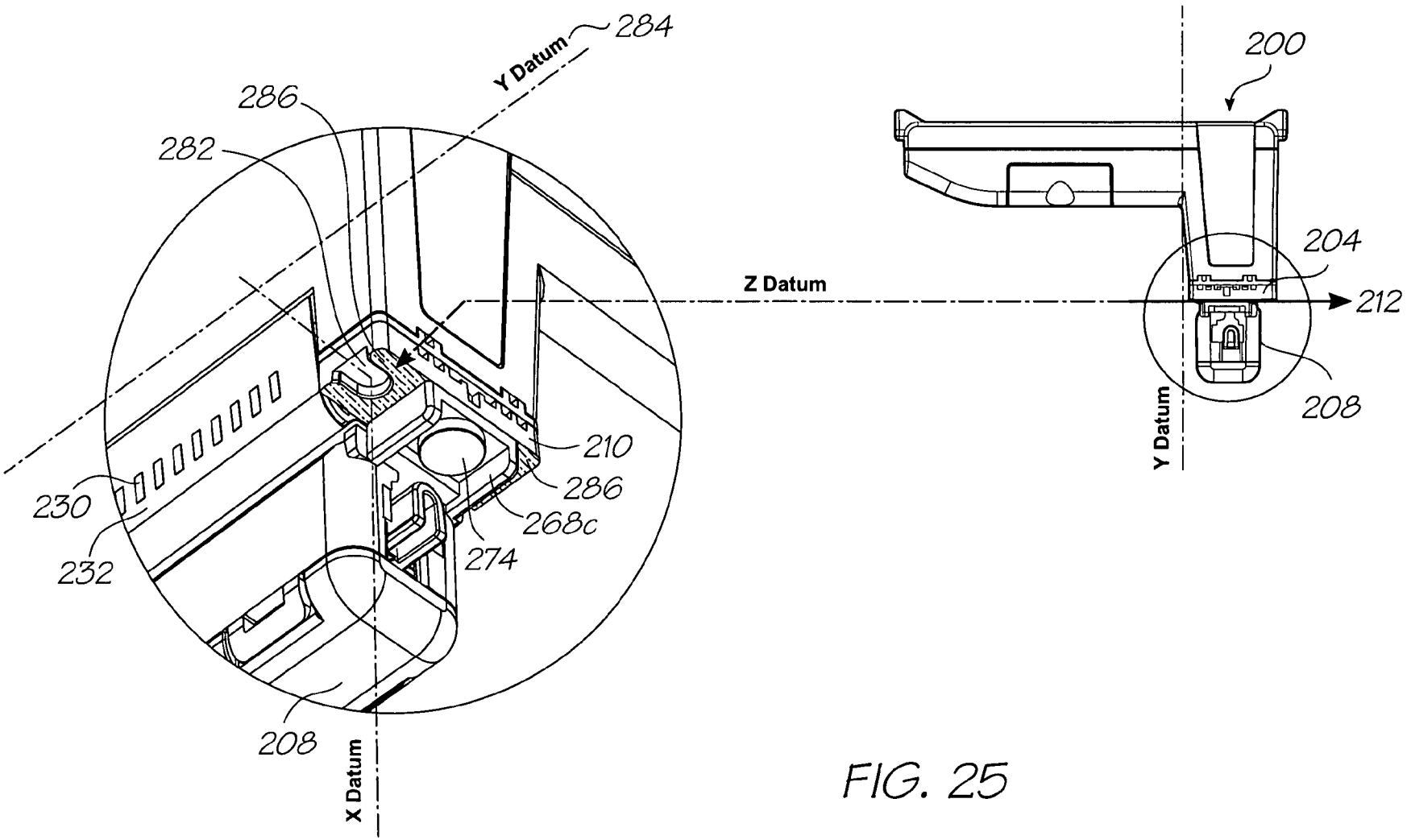

As illustrated in FIGS. 25 and 25A, the X datum corresponds to a centreline of a slot 282 in the mounting zone 210*a* of the ink distribution support 210 at the fixed end of the printhead 204 and capper 208 (e.g., at the right hand end as depicted in FIG. 25A) which is located immediately adjacent the flexible printed circuit board 232 (see also FIG. 6). The Y datum corresponds to a line 284 across the printhead cartridge 200 just above the electrical contacts 230 of the flexible printed circuit board 232, at which point the exterior surface of the printhead cartridge body 202 is at a slight angle to the vertical (e.g., in the illustrated embodiment a clearance angle of five degrees is provided). The Z datum corresponds to four flat surfaces 286 on the corners of the upper portion 240 of the ink distribution support 210 which face the cradle unit 400 (i.e., the corners of the underside of the upper portion 240 as depicted in FIG. 25A, which is the same surface in which the slot 282 of the X datum is defined; see also FIG. 6).

In this way, the X, Y and Z datums are located as close as possible to the printing zone 219 of the printhead 204 in order to reduce the effect of accumulated tolerances across multiple components. Providing these reference features on the printhead itself, allows the printhead to be self referencing, which in turn accommodates the aforementioned tight tolerances. Other referencing arrangements are possible so long as the small tolerances are accommodated.

An example of the manner in which these reference features cooperate with complementary mounting features of the cradle unit is illustrated in FIGS. 26, 26A, 26B and 26C. The X datum slot 282 of the printhead cartridge 200 is received in a complementary shaped mesa feature 404 situated within a cartridge receiving slot 406 of the cradle unit 400 (see FIGS. 4 and 26B). The Y datum angled surface 284 of the printhead cartridge 200 is held against a protrusion 408 situated across the cartridge receiving slot 406 of the cradle unit 400 (see FIG. 26A). The cradle unit protrusion 408 is the part of the connection interface which carries the electrical contacts of the print control circuitry and power supply for connection to the contacts 230 of the flexible printed circuit board 232. The Z datum flat surfaces 286 locate on protrusions 410 within the cartridge receiving slot 406 of the cradle unit 400 (see FIG. 26C).

By locating the X datum slot, one end of the Y datum line and two of the Z datum flat surfaces at the fixed end of the printhead and capper, the exact location of each of the reference features can be known throughout movement of the printhead and capper at the confined end. The print control circuitry of the printer uses the cooperation of these reference features of the printhead cartridge 200 with the known positions of the mounting features of the cradle unit 400 in order to control the firing of the nozzles.

Figure 3:
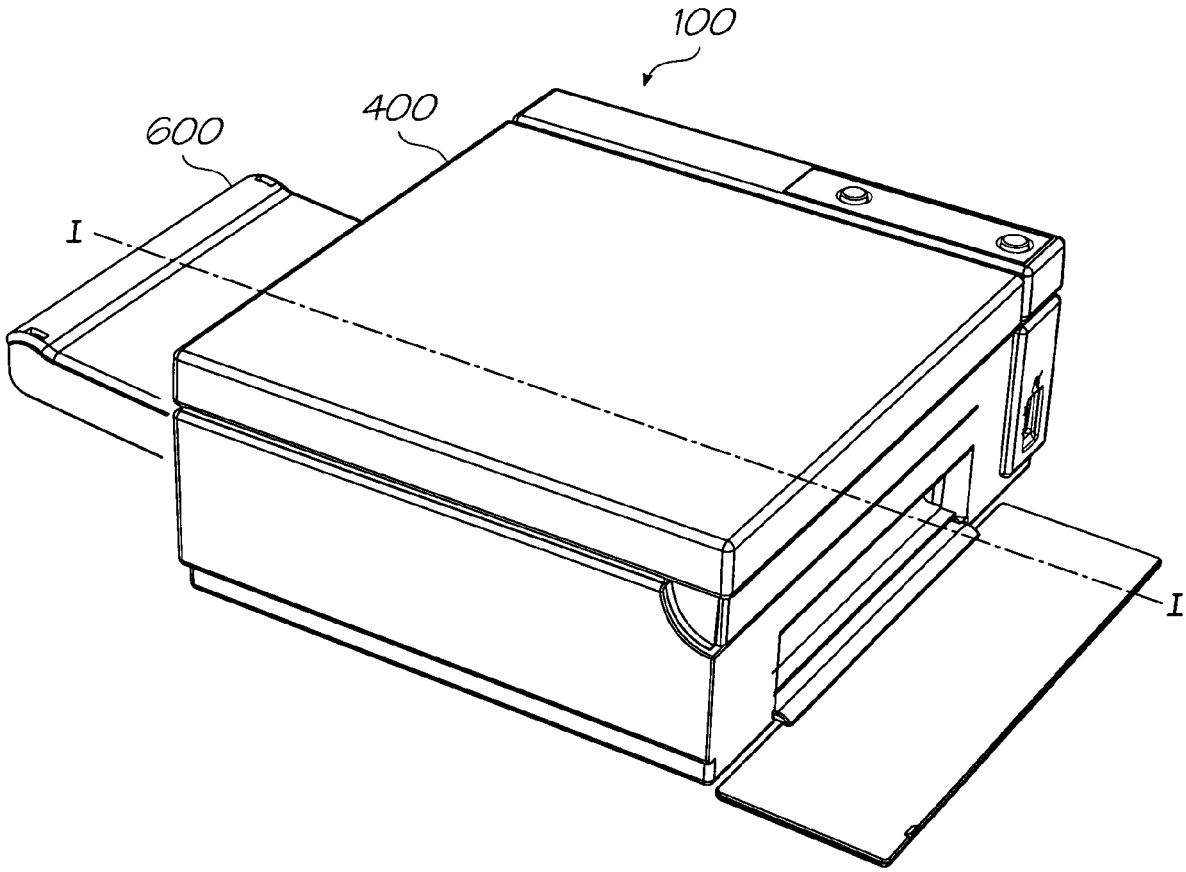
FIG. 3 shows a perspective view of the printer.

Once the printhead cartridge 200 has been inserted into the cartridge receiving slot 406 of the cradle unit 400 to make the above described cooperative connections, the printhead cartridge 200 is held in place by a lid 412 of the cradle unit 400 (see FIGS. 3 and 4). In the illustrated embodiment, correct alignment and contact can be maintained by configuring the lid 412 of the cradle unit 400 to exert a vertical force of about 20 Newtons to the lid of the printhead cartridge body 202 (with a similar force being required to be exerted by a user to insert the printhead cartridge 200), and by configuring the slant angle of the printhead cartridge body 202 at the Y datum line 284 to cause the connection protrusion 408 of the cradle unit 400 to exert a horizontal force of about 45 Newtons to the electrical contacts 230 of the flexible printed circuit board 232.

Figure 2:
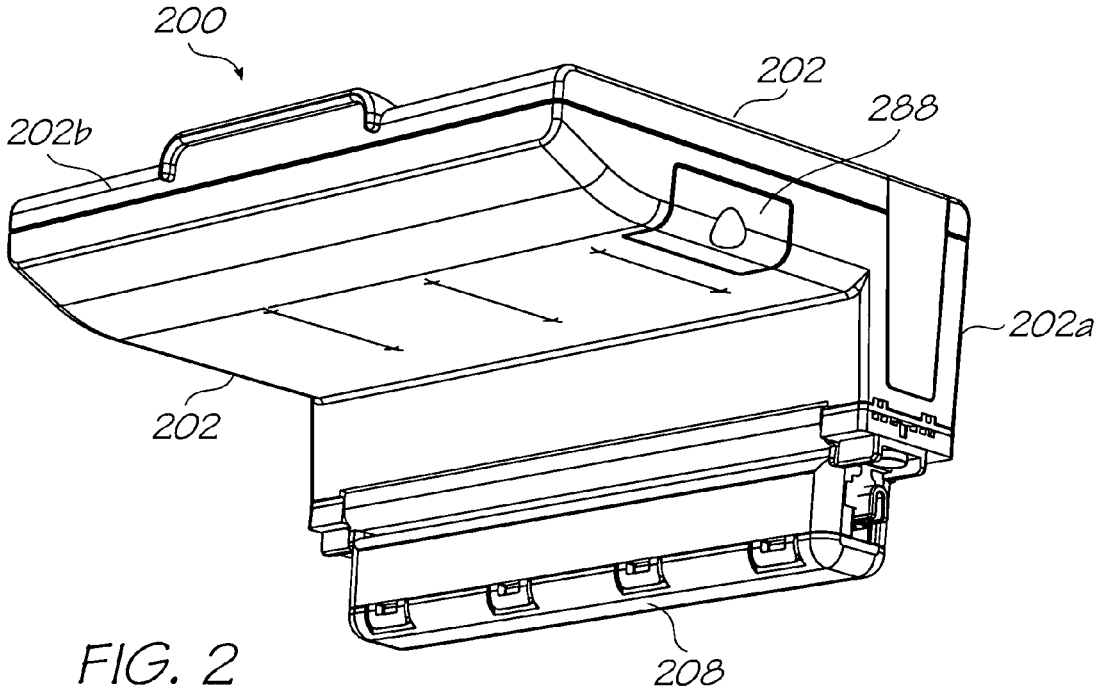
FIG. 2 shows a bottom elevational perspective view of the printhead cartridge.
Figure 26:
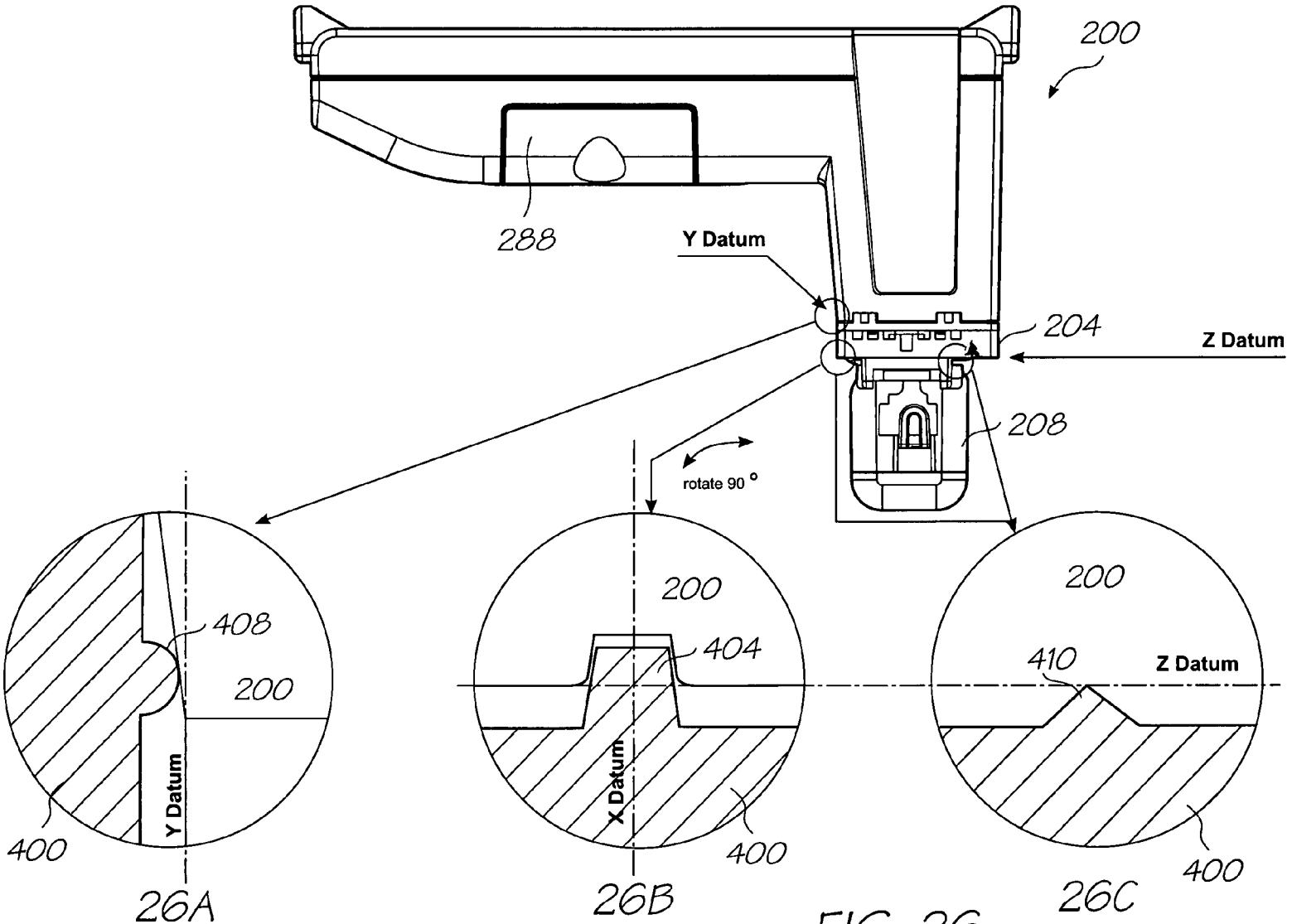

In order to ensure that the printhead cartridge 200 may only be used with a printer/cradle unit which is properly configured to operate the printhead cartridge 200, it is possible to arrange a key feature 288 on the printhead cartridge 200, as illustrated in FIGS. 2 and 26, for example, which only allows the printhead cartridge 200 to be inserted into a printer/cradle unit having a complementary key feature. Such 'branding' of the printhead cartridge 200 and printer/cradle unit can be carried out after manufacture.

While the present invention has been illustrated and described with reference to exemplary embodiments thereof, various modifications will be apparent to and might readily be made by those skilled in the art without departing from the scope and spirit of the present invention. Accordingly, it is not intended that the scope of the claims appended hereto be limited to the description as set forth herein, but, rather, that the claims be broadly construed.

The invention claimed is:

1. An ink priming arrangement for an inkjet printhead, the inkjet printhead having a plurality of ink ejection nozzles, the priming arrangement comprising:

an ink bag containing ink for distribution to the nozzles via a fluid path between the ink bag and the nozzles;

a force applicator arranged to apply inwardly directed force on at least one exterior wall of the ink bag so as to reduce an available fluid volume of the ink bag, thereby causing ink to flow from the ink bag to the nozzles along the fluid path; and a biasing member arranged in the ink bag to apply outwardly directed force on at least one interior wall of the ink bag so as to restrain the reduction of available fluid volume of the ink bag, wherein the biasing member is configured so as to apply the outwardly directed force only once the available fluid volume of the ink bag has been reduced to a predetermined volume, and the fluid path connects the ink bag to at least 6400 nozzles of the printhead.

2. An ink priming arrangement according to claim 1, wherein the biasing member incorporates a leaf spring.

3. An ink priming arrangement according to claim 2, wherein the leaf spring is made from a material having shape-memory characteristic.

4. An ink priming arrangement according to claim 3, wherein the material is Mylar.

5. An ink priming arrangement according to claim 2, wherein the leaf spring is formed by folding an elongate arcuate piece of the material about an approximate centre line orthogonal to the longitudinal extent thereof so that the leaf spring exhibits an outwardly directed spring restoring force.

6. An ink priming arrangement according to claim 5, wherein the leaf spring is formed so as to have a folded longitudinal length and radius of curvature which result in the leaf spring being able to float within the ink contained in the ink bag prior to the application of the inwardly directed force by the force applicator.

7. An ink priming arrangement according to claim 1, wherein the ink bag is configured to have an available fluid volume of at least 19 milliliters.

8. An ink priming arrangement according to claim 7, wherein the ink bag is configured to have an available fluid volume of at least 23 milliliters.

9. An ink priming arrangement according to claim 7, wherein the predetermined available fluid volume is at least 15 milliliters.

10. An ink priming arrangement according to claim 1, wherein the nozzles of the printhead are arranged so as to print at a resolution of 1600 dots per inch.

11. An ink priming arrangement according to claim 1, comprising three of said ink bags.

12. An ink priming arrangement according to claim 11, wherein a first ink bag contains magenta ink, a second ink bag contains cyan ink and a third ink bag contains yellow ink.

13. An ink priming arrangement according to claim 12, wherein the fluid path of the first ink bag connects the first ink bag to 12800 nozzles of the printhead, the fluid path of the second ink bag connects the second ink bag to 12800 nozzles of the printhead, and the fluid path of the third ink bag connects the third ink bag to 6400 nozzles of the printhead.

14. An ink priming arrangement according to claim 13, wherein the printhead has 32000 nozzles.

15. An ink priming arrangement according to claim 14, wherein the printhead is a pagewidth printhead, having a pagewidth of 100.9 millimeters.

16. An ink priming arrangement according to claim 15, wherein the printhead comprises five linked printhead integrated circuits arranged to span the pagewidth, each printhead integrated circuit having 6400 nozzles arranged in rows.

17. An ink priming arrangement according to claim 16, wherein the fluid path of each ink bag connects the respective ink bag to at least two nozzle rows of each printhead integrated circuit.

18. An ink priming arrangement according to claim 17, wherein the fluid path of first ink bag connects the first ink bag to four nozzle rows of each printhead integrated circuit, the fluid path of second ink bag connects the second bag to four nozzle rows of each printhead integrated circuit, and the fluid path of third ink bag connects the third ink bag to two nozzle rows of each printhead integrated circuit.

* * * * *